US010072486B2

(12) United States Patent
Bennett et al.

(10) Patent No.: US 10,072,486 B2
(45) Date of Patent: Sep. 11, 2018

(54) APPARATUS, SYSTEM AND METHOD FOR LIVE WELL ARTIFICIAL LIFT COMPLETION

(71) Applicant: Summit ESP, LLC, Tulsa, OK (US)

(72) Inventors: Bruce Richard Bennett, Sundre (CA); John Farrar Hedges, Cochrane (CA); Walter Russell Dinkins, Tulsa, OK (US)

(73) Assignee: SUMMIT ESP, LLC, Tulsa, OK (US)

( * ) Notice: Subject to any disclaimer, the term of this patent is extended or adjusted under 35 U.S.C. 154(b) by 0 days.

(21) Appl. No.: 15/592,119

(22) Filed: May 10, 2017

(65) Prior Publication Data

US 2017/0328186 A1 Nov. 16, 2017

Related U.S. Application Data

(60) Provisional application No. 62/335,068, filed on May 11, 2016.

(51) Int. Cl.
*E21B 43/00* (2006.01)
*E21B 17/00* (2006.01)
(Continued)

(52) U.S. Cl.
CPC ..... *E21B 43/128* (2013.01); *E21B 17/206* (2013.01); *E21B 33/03* (2013.01);
(Continued)

(58) Field of Classification Search
CPC ..... E21B 43/128; E21B 33/03; E21B 17/206
See application file for complete search history.

(56) References Cited

U.S. PATENT DOCUMENTS 6,298,917 B1 10/2001 Kobylinski et al.
6,328,111 B1 12/2001 Bearden et al.
(Continued)

FOREIGN PATENT DOCUMENTS

EP 0505815 A2 9/1992
WO 2016025810 A1 2/2016

OTHER PUBLICATIONS

Korean Intellectual Property Office, "International Search Report" for PCT Application No. PCT/US2017/032038, dated Aug. 10, 2017, 3 pages.
(Continued)

*Primary Examiner* — Robert E Fuller
(74) *Attorney, Agent, or Firm* — McGuireWoods LLP

(57) ABSTRACT

An apparatus, system and method for live well artificial lift completion. A live well artificial lift completion system includes an artificial lift pump discharge, a discharge adapter body secured between the artificial lift pump discharge and an umbilical, the discharge adapter body including an electrical connector fastened to an exterior of the discharge adapter body, an inner diameter of the discharge adapter body fluidly coupled to the artificial lift pump discharge, the umbilical including coiled tubing supportively hanging from an umbilical hanger within a wellhead, the umbilical hanger positioned in a tubing head spool, an inner diameter of the coiled tubing fluidly coupled to the inner diameter of the discharge adapter body, a jacket surrounding the coiled tubing, and a power cable extruded inside the jacket, wherein the power cable is connectable between the electrical connector of the discharge adapter body and a surface power source.

10 Claims, 24 Drawing Sheets

(51) Int. Cl.

| | |
|---|---|
| ***E21B 43/12*** | (2006.01) |
| ***E21B 17/20*** | (2006.01) |
| ***F04D 1/06*** | (2006.01) |
| ***F04D 13/10*** | (2006.01) |
| ***E21B 33/12*** | (2006.01) |
| ***E21B 33/03*** | (2006.01) |

(52) U.S. Cl.
CPC ..... *E21B 33/12* (2013.01); *F04D 1/06* (2013.01); *F04D 13/10* (2013.01)

(56) References Cited

U.S. PATENT DOCUMENTS

| | | | | |
|---|---|---|---|---|
| 6,538,198 | B1 | 3/2003 | Wooters | |
| 6,776,230 | B2 | 8/2004 | Collie et al. | |
| 7,770,656 | B2 | 8/2010 | Zupanick | |
| 8,915,303 | B2 | 12/2014 | Chalifoux | |
| 2009/0001304 | A1* | 1/2009 | Hansen | E21B 34/06 251/129.02 |
| 2012/0121224 | A1* | 5/2012 | Dalrymple | E21B 17/023 385/101 |
| 2013/0209290 | A1* | 8/2013 | Fielder | E21B 43/128 417/410.1 |
| 2013/0277042 | A1 | 10/2013 | Scarsdale et al. | |
| 2013/0315751 | A1 | 11/2013 | Fielder et al. | |
| 2014/0367121 | A1* | 12/2014 | Varkey | E21B 47/123 166/385 |
| 2016/0076330 | A1 | 3/2016 | Roth et al. | |

OTHER PUBLICATIONS

International Searching Authority, "Written Opinion of the International Searching Authority" for PCT Application No. PCT/US2017/032038, dated Aug. 10, 2017, 5 pages.

* cited by examiner

UMBILICAL HANGING METHOD

APPARATUS, SYSTEM AND METHOD FOR LIVE WELL ARTIFICIAL LIFT COMPLETION

CROSS REFERENCE TO RELATED APPLICATIONS

The present application claims the benefit of U.S. Provisional Application No. 62/335,068 to Bennett et al., filed May 11, 2016 and entitled "APPARATUS, SYSTEM AND METHOD FOR LIVE WELL ARTIFICIAL LIFT COMPLETION," which is hereby incorporated by reference in its entirety.

BACKGROUND OF THE INVENTION

1. Field of the Invention

Embodiments of the invention described herein pertain to the field of hydrocarbon well completion. More particularly, but not by way of limitation, one or more embodiments of the invention enable an apparatus, system and method for live well artificial lift completion.

2. Description of the Related Art

In oil and gas wells, completion is the process of making the well ready for production. The completion process conventionally involves preparing the bottom of the hole to the required specifications, running in the production tubing and its associated downhole tools, as well as perforating and stimulating as required. In many well applications, particularly in gassy wells or wells containing hydrogen sulfide, fluid and pressure management is desirable to improve production from the formation. Current methods of artificial lift installation require heavy kill fluids to manage pressure during workover. However, kill fluids can damage the formation resulting in lower well productivity after workover and deployment. In addition, pressure management can be time consuming, which adds to workover costs in remote or offshore areas.

Artificial lift assemblies, such as electric submersible pump (ESP) assemblies and electric submersible progressive cavity pumps (ESPCP) assemblies are used to pump fluid from the well to the surface. Conventionally, artificial lift assemblies are deployed using kill fluids for uncontrolled flow protection, with blowout preventers used as backup protection in the instance well fluid begins to flow to surface. In this conventional deployment technique, the well bore is open during positioning and connection of the pump. In wells with significant concentrations of hydrogen sulfide ($H_2S$), an open well can present safety hazards since $H_2S$ is poisonous, corrosive, flammable, and explosive. In addition, kill fluids are harmful to well production by limiting productivity of the well.

Conventional deployment of artificial lift assemblies also utilizes service or workover rigs that are limited in height, costly and difficult to mobilize. This can lead to delays in deployment due to difficulties with scheduling and execution.

Artificial lift assemblies such as ESPs or ESPCPs typically operate with their motors thousands of feet beneath the ground, and the pump motor requires power. As such, a power cable extends from the downhole motor deep within the well, to a power source at the surface of the well. These power cables are typically between about 4,000 to 12,000 feet in length, depending on well depth, since the cable must extend from deep within the well to the surface where the power source is located. The power cable is conventionally banded or clamped to the outside of the production tubing, which further limits pressure management since a tight seal cannot form between the pump equipment string and the hole or well casing. This may limit pressure management options since a tight seal cannot form around the production tubing and the ESP cable string, and increase the need for kill fluid during deployment, which is undesirable since kill fluid adversely affects well production.

As is apparent from the above, current well completion systems suffer from many drawbacks including difficulties with pressure management, the use of kill fluids, and cost and scheduling limitations due to the need for well servicing rigs. Therefore, there is a need for an improved apparatus, system and method for live well artificial lift completion.

BRIEF SUMMARY OF THE INVENTION

One or more embodiments of the invention enable an apparatus, system and method for live well artificial lift completion.

An apparatus, system and method for live well artificial lift completion is described. An illustrative embodiment of a live well artificial lift completion system includes an artificial lift pump discharge, a discharge adapter body secured between the artificial lift pump discharge and an umbilical, the discharge adapter body including an electrical connector fastened to an exterior of the discharge adapter body, an inner diameter of the discharge adapter body fluidly coupled to the artificial lift pump discharge, the umbilical including coiled tubing, the coiled tubing supportively hanging from an umbilical hanger within a wellhead, the umbilical hanger secured to a tubing hanger, the tubing hanger and umbilical hanger positioned in a tubing head spool, an inner diameter of the coiled tubing fluidly coupled to the inner diameter of the discharge adapter body, a jacket surrounding the coiled tubing, and a power cable extruded inside the jacket, wherein the power cable is connectable between the electrical connector of the discharge adapter body and a surface power source. In some embodiments the live well artificial lift completion system includes a multi-stage centrifugal pump fluidly coupled to the artificial lift pump discharge, the multi-stage centrifugal pump driven by an electric submersible motor, the electric submersible motor electrically coupled to the electrical connector of the discharge adapter body. In certain embodiments, a motor lead cable, the electrical connector and the power cable together extend between the electric submersible motor and the surface power source to provide power to the electric submersible motor. In some embodiments, the multi-stage centrifugal pump is positioned in a downhole well and the multi-stage centrifugal pump lifts production fluid through the pump discharge, through the inner diameter of the discharge adapter body, and through the inner diameter of the coiled tubing of the umbilical. In some embodiments, the live well artificial lift completion system includes a plurality of the power cables extruded inside the jacket, and at least one supportive rib extruded inside the jacket between two adjacent power cables of the plurality of power cables. In certain embodiments, the live well artificial lift completion system includes three power phases extruded inside the jacket, each power phase split into two power cables, and wherein a rib is supportively engaged between the two power cables of each power phase. In certain embodiments, a capillary tube is extruded inside the jacket. In some embodiments, the live well artificial lift completion system includes a blowout plug removeably attached within the artificial lift pump discharge. In certain embodiments, the blowout plug is moveable between a blocking position that prevents fluid flow through the artificial lift pump discharge, wherein the blowout plug is secured in a nipple in the blocking position, and an open position that opens the artificial lift pump discharge to fluid flow, the blowout plug positioned in a catcher in the open position. In some embodiments the jacket includes a pair of plastic walls and a fiber filling between the pair of plastic walls, wherein the power cable is extruded in the fiber filling.

An illustrative embodiment of a method of live well artificial lift completion includes hanging an umbilical on a wellhead of a live well, the umbilical fluidly coupling a production pump to a well surface and electrically coupling an electric motor to a surface power source, the electric motor powering the production pump, the umbilical including coiled tubing surrounded by a jacket, and power cables extruded inside the jacket to form a smooth jacket outer surface, creating a pressure seal inside the umbilical during deployment of the umbilical into the live well, the pressure seal inside the umbilical created using a blowout plug positioned to block a discharge of the production pump, and forming an annular pressure seal during deployment of the production pump to obtain well control, the annular pressure seal formed using an annular bag coupled to the wellhead. In some embodiments, the smooth jacket outer surface of the umbilical allows formation of the annular pressure seal between the umbilical and well casing. In certain embodiments, the method of live well artificial lift completion further includes attaching a discharge adapter body between the umbilical and the discharge of the production pump, the discharge adapter body, fluidly coupling an inner diameter of the coiled tubing to the production pump discharge, and electrically coupling the electric motor to the power cables. In some embodiments, the method of live well artificial lift completion further includes lowering the production pump to operating depth within the live well, the production pump hanging below the umbilical, over-pressuring the blowout plug to unblock the discharge of the production pump, and operating the production pump to lift fluid upwards through the pump discharge, through the adapter discharge body, and through the inside of the coiled tubing to a surface of the live well. In some embodiments, the method of live well artificial lift completion further includes powering the electric motor using the power cables inside the umbilical. In certain embodiments, hanging the umbilical on the wellhead includes threading an umbilical hanger to a tubing hanger and landing the umbilical hanger and the tubing hanger on a tubing head spool.

In further embodiments, features from specific embodiments may be combined with features from other embodiments. For example, features from one embodiment may be combined with features from any of the other embodiments. In further embodiments, additional features may be added to the specific embodiments described herein.

BRIEF DESCRIPTION OF THE DRAWINGS

The above and other aspects, features and advantages of illustrative embodiments of the invention will be more apparent from the following more particular description thereof, presented in conjunction with the following drawings wherein.

Figure 1:
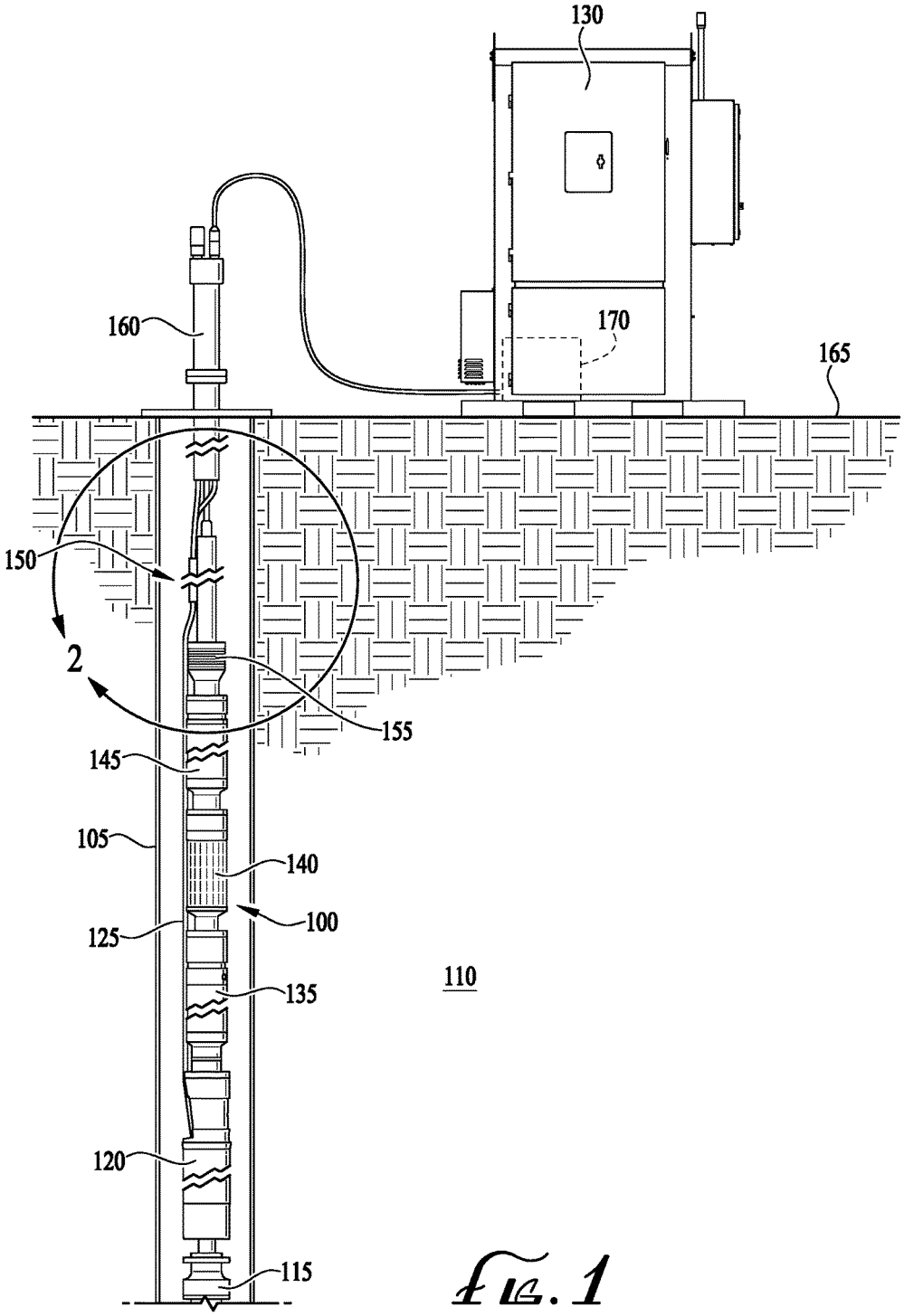
FIG. 1 is a perspective view of an electric submersible pump (ESP) assembly with umbilical conduit system of an illustrative embodiment deployed in a downhole well.

While the invention is susceptible to various modifications and alternative forms, specific embodiments thereof are shown by way of example in the drawings and may herein be described in detail. The drawings may not be to scale. It should be understood, however, that the embodiments described herein and shown in the drawings are not intended to limit the invention to the particular form disclosed, but on the contrary, the intention is to cover all modifications, equivalents and alternatives to such embodiments that fall within the scope of the present invention as defined by the appended claims.

DETAILED DESCRIPTION

An apparatus, system and method for live well artificial lift completion will now be described. In the following exemplary description, numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

As used in this specification and the appended claims, the singular forms "a", "an" and "the" include plural referents unless the context clearly dictates otherwise. Thus, for example, reference to a power cable includes one or more power cables.

"Coupled" refers to either a direct connection or an indirect connection (e.g., at least one intervening connection) between one or more objects or components. The phrase "directly attached" means a direct connection between objects or components.

As used herein, the term "outer" or "outward" means the radial direction towards the casing of a downhole well. In the art, "outer diameter" (OD) and "outer circumference" are sometimes used equivalently. As used herein, the outer diameter is used to describe what might otherwise be called the outer circumference or outer surface of a component, such as the outer surface of a coiled tube.

As used herein, the term "inner' or "inward" means the radial direction away from the casing a downhole well. In the art, "inner diameter" (ID) and "inner circumference" are sometimes used equivalently. As used herein, the inner diameter is used to describe what might otherwise be called the inner circumference or inner surface of a component.

As used herein, the term "live well" means an underbalanced well, when the pressure (or force per unit area) exerted on a formation exposed in a wellbore is less than the internal fluid pressure of that formation. If sufficient porosity and permeability exist, formation fluids enter the wellbore.

As used herein the terms "axial", "axially", "longitudinal" and "longitudinally" refer interchangeably to the direction extending along the length of the tubing of an artificial lift assembly component such as an umbilical or discharge adapter body.

"Downstream" refers to the direction substantially with the principal flow of working fluid when the production pump assembly is in operation. By way of example but not limitation, in a vertical downhole electric submersible pump (ESP) assembly, the downstream direction may be towards the surface of the well. The "top" of an element refers to the downstream-most side of the element.

"Upstream" refers to the direction substantially opposite the principal flow of working fluid when the pump assembly is in operation. By way of example but not limitation, in a vertical downhole ESP assembly, the upstream direction may be opposite the surface of the well. The "bottom" of an element refers to the upstream-most side of the element.

For ease of description and so as not to obscure the invention, illustrative embodiments are described in terms of ESP assemblies which may be used in well applications where fluid and pressure management is desired to improve production from a formation. However, illustrative embodiments are not so limited and may be employed in electric submersible progressive cavity pumps (ESPCP) or other similar types of electrical artificial lift.

Illustrative embodiments provide apparatus and methods for live well artificial lift completion. Illustrative embodiments may provide well completion without the need for kill fluids and may enable pressure management during completion of live wells, pressure management both inside an umbilical and between the umbilical and well casing (annular pressure). The live well completion capsule of illustrative embodiments may reduce or eliminate safety and time related issues with live well artificial lift installations by reducing exposure to well gases such as $H_2S$ and eliminating the need for a service rig. Since the installation method of illustrative embodiments only requires a crane and/or coil tube rig rather than a service rig, areas with high rig costs or limited rig availability may benefit from illustrative embodiments.

Illustrative embodiments provide a live well completion capsule that may accomplish live well deployment with complete pressure management. The system of illustrative embodiments includes an improved coil tube umbilical. Rather than having an artificial lift power cable attached to the outer length of the umbilical with fasteners, bands, slips and/or clamps, the umbilical of illustrative embodiments includes artificial lift power cables, ground cable and/or capillaries extruded inside a jacket of the umbilical. In this fashion, the power cables do not protrude and may enable a pressure seal to form in the annulus, between the umbilical and the well casing. The umbilical may be connected between the wellhead and a discharge adapter body, pump discharge and/or other top portion of the downhole pump equipment string. At the connection between the umbilical conduit system and the pump discharge, a blowout plug may be placed inside the pump discharge. The blowout plug may maintain pressure inside the umbilical in instances where there is more pressure inside the hole that in the atmosphere. At the connection between the umbilical and the wellhead, an improved electrical feedthrough and wellhead hanger may be employed with a dual function. The wellhead hanger may include an annular bag, as well as a dognut style umbilical tubing hanger. The wellhead hanger may support the weight of the umbilical as well as maintain annular pressure (pressure between the outer diameter of the umbilical and the well casing). The improved umbilical system of illustrative embodiments may enable formation of the pressure seal by virtue of the smooth jacket outer surface, free of protruding power cables.

Illustrative embodiments may include a method of live well completion that incorporates umbilical hanging and umbilical stripping methods. An annular bag wellhead design may allow installation and commissioning of an ESP assembly with an attached umbilical system of illustrative embodiments. A method of live well completion may include hanging an umbilical on a wellhead of a live well, the umbilical fluidly coupling a production pump to a well surface and electrically coupling an electric motor to a surface power source, creating a pressure seal inside the umbilical during deployment of the umbilical into the live well, the pressure seal inside the umbilical created using a blowout plug positioned to block a discharge of the production pump, and forming a pressure seal in the annulus, outside the umbilical between the production pump and a well casing during deployment of production pump, the annular pressure seal formed using an annular bag coupled to the wellhead.

Illustrative embodiments may provide a system and method for live well artificial lift completion. FIG. 1 illustrates an artificial lift assembly including an umbilical conduit system of illustrative embodiments deployed in a downhole well. FIG. 1 shows the artificial lift assembly after live well completion has been effectuated. FIG. 1 illustrates an ESP embodiment, but the invention may equally be employed in an ESPCP embodiment. ESP assembly 100 may be located in a downhole well, with casing 105 separating ESP assembly 100 from underground formation 110. ESP assembly 100 may include downhole sensors 115 which may sense motor temperature, motor speed and/or other downhole and pump operating conditions. Motor 120 may be an electric submersible motor such as two-pole, three-phase squirrel cage induction motor or permanent magnet motor. Power cable 125 may plug or tape into motor 120 with a motor lead extension, providing power to motor 120. In three-phase embodiments, such as with three-phase squirrel cage induction motors, power cable 125 may include three phases. Power cable 125 may include a motor lead extension at the connection to the motor, extension cord power cable phases and/or electrical connectors extending to surface 165. Power cable 125 may connect to power source 170 at surface 165 of the well. In some embodiments, power cable 125 may carry information from downhole sensors 115 to a variable speed drive (VSD) controller located in surface cabinet 130. Seal section 135 may equalize pressure and serve to protect motor 120 from well fluid. Intake 140 may serve as the entry for well fluid into pump 145. Pump 145 may be a multi-stage centrifugal pump, ESP pump and/or progressive cavity pump that lifts fluid through umbilical conduit system 150 to surface 165 of the well. Pump discharge 155 may couple pump 145 to umbilical conduit system 150. Wellhead 160 may be the surface termination of the wellbore and may provide structural support for hanging of ESP assembly 100, pressure control during well completion and/or surface flow controls.

Figure 2:
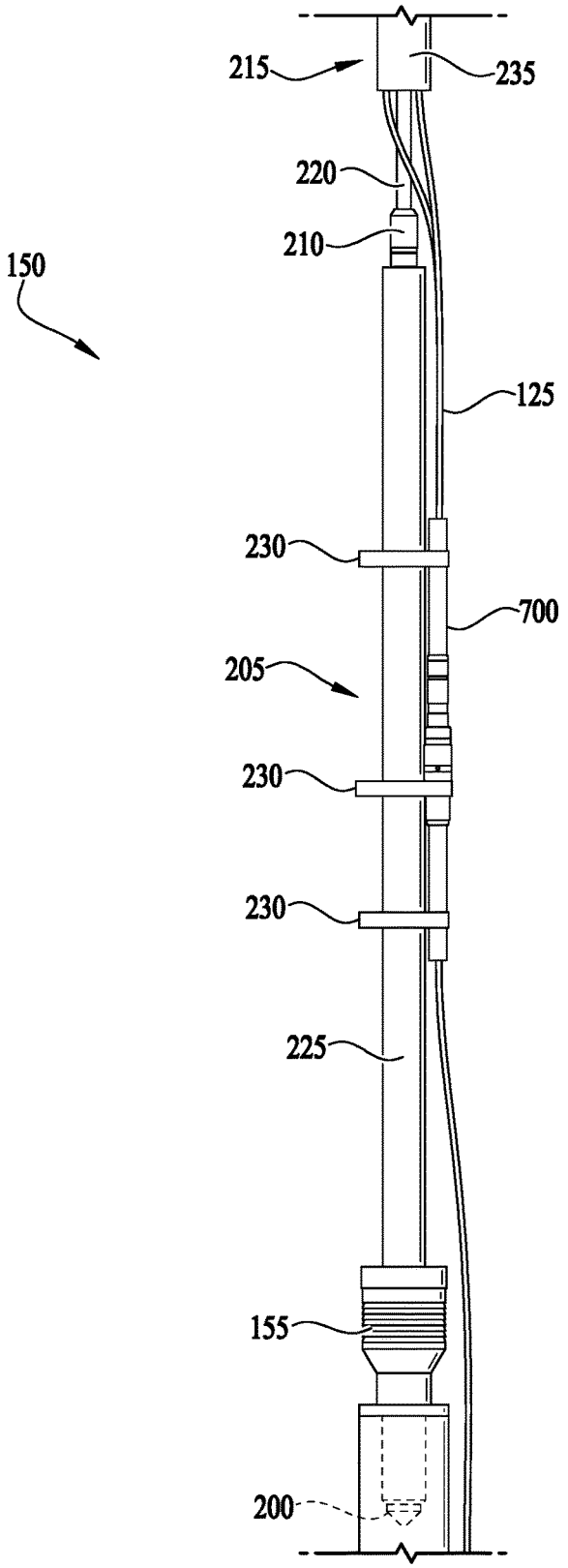
FIG. 2 is a perspective view of an umbilical conduit system of an illustrative embodiment.

Umbilical conduit system 150 may effectuate live well completion by carrying production fluid from pump discharge 155 to well surface 165 while also conveying power cable 125 to surface power source 170 without disturbing the pressure seal at wellhead 160. As shown in FIG. 2, umbilical conduit system 150 may include from bottom to top, pump discharge 155 with blowout plug 200, discharge adapter body 205, grapple 210 and umbilical 215. Discharge adapter body 205 may be bolted to pump discharge 155 on a bottom end and threaded to grapple 210 on a top end, or may include other similar connections. Discharge adapter body 205 may include pipe 225, and the inside of pipe 225 may carry production fluid upwards towards coiled tubing 220. Grapple 210 may seal the threaded end of discharge adapter body 205 to coiled tubing 220 of umbilical 215, such that production fluid flows from the inside of pipe 225 to the inside of coiled tubing 220. Power cables 125 may be connected into electrical connectors 700 of discharge adapter body 205, enabling the motor lead cable and/or extension cord from motor 120 to electrically connect into power cables 125 of umbilical 215. Electrical connectors 700 may be secured to the outside of pipe 225 with fasteners 230, which may be clamps, bands or another similar attachment. When power cables 125 reach umbilical 215, power cables 125 may continue inside of jacket 235 of umbilical 215.

Figure 3A:
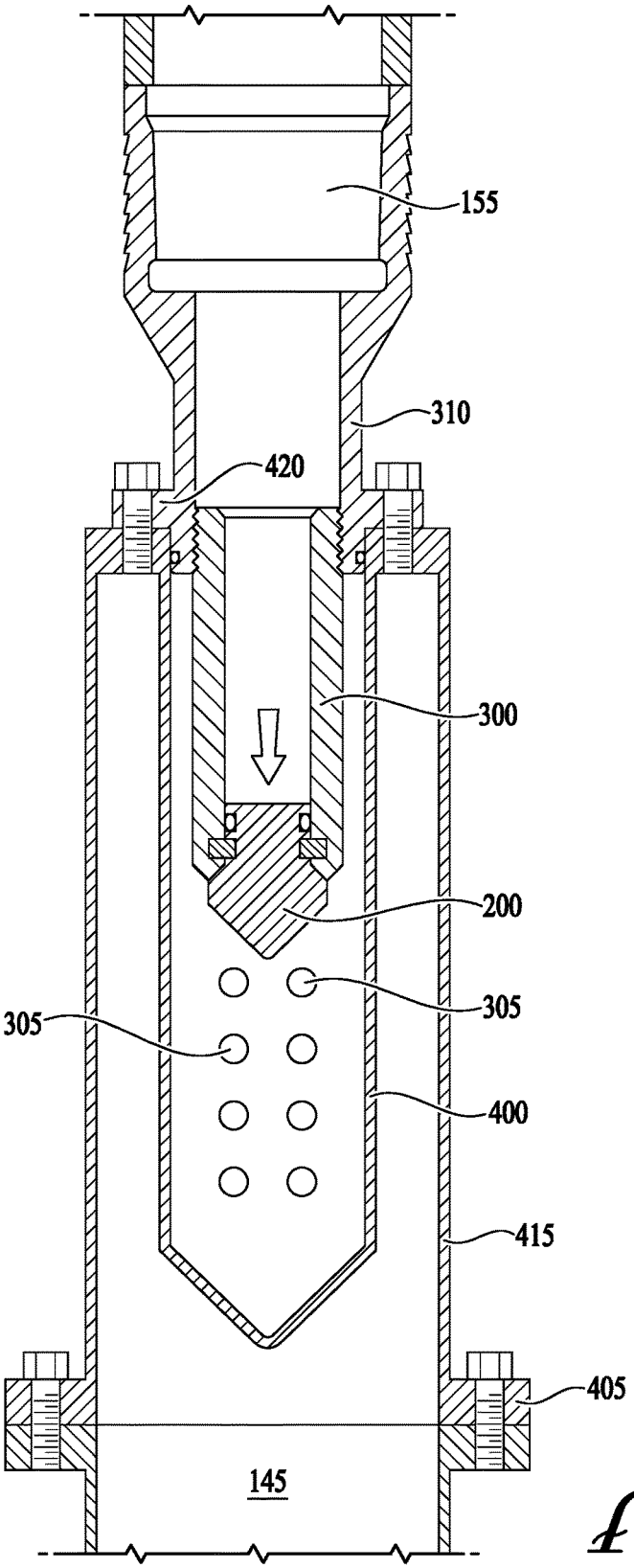
FIG. 3A is a cross sectional view of an exemplary pump discharge with blowout plug in a blocking position of an illustrative embodiment.
Figure 3B:
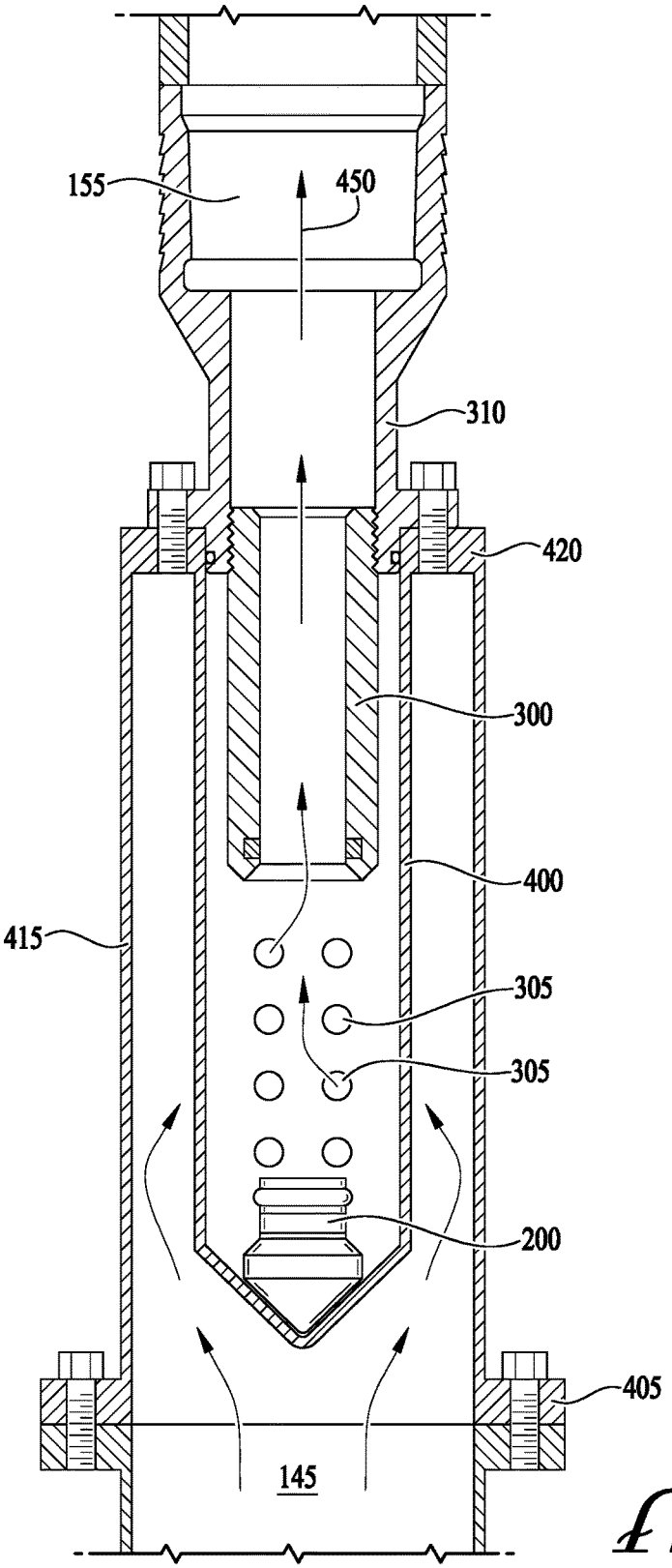
FIG. 3B is a cross sectional view of an exemplary pump discharge with blowout plug in catcher and production fluid flowing upwards.

Pump discharge 155 with blowout plug 200 or drop dart 500 may isolate the inner conduits of umbilical conduit system 150 from wellbore pressure during installation and retrieval. FIG. 3A and FIG. 3B illustrate a pump discharge with a blowout plug assembly of illustrative embodiments. During deployment and/or lowering of ESP assembly 100 into a live well, blowout plug 200 may be placed in a blocking position inside pump discharge 155, as illustrated in FIG. 3A. Blowout plug 200, when in a blocking position, may be removeably attached to nipple 300, preventing production fluid 450 from flowing upwards into pipe 225. Once ESP assembly 100 is secured in an operating position and/or at operating depth within a well, interior of coiled tubing 220 may be over-pressured to pop blowout plug 200 into catcher 400 and/or decouple blowout plug 200 from discharge 155, such that blowout plug 200 no longer blocks production flow. FIG. 3B illustrates blowout plug 200 in a blown-out position, where blowout plug 200 is resting in catcher and production fluid 450 flows upward through umbilical conduit system. Production fluid 450 may then follow an unobstructed path through umbilical conduit system 150 to well surface 165. Catcher 400 may include a plurality of apertures 305 to provide a pathway for production fluid 450 through catcher 400.

Figure 4A:
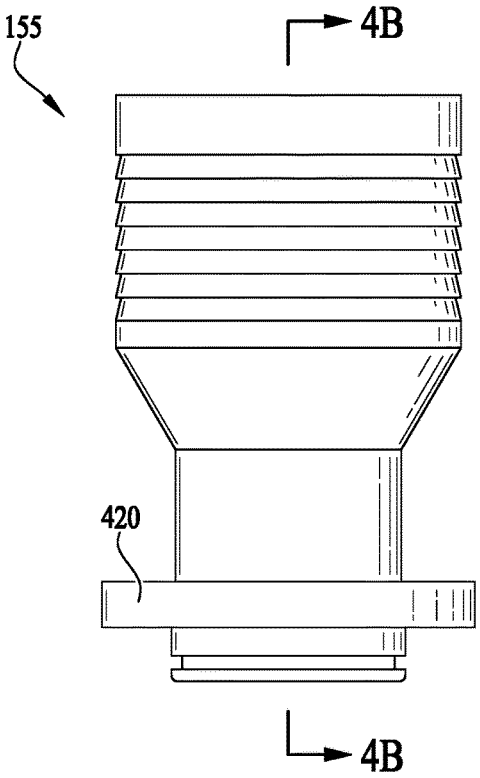
FIG. 4A is a perspective view of a pump discharge of an illustrative embodiment.
Figure 4B:
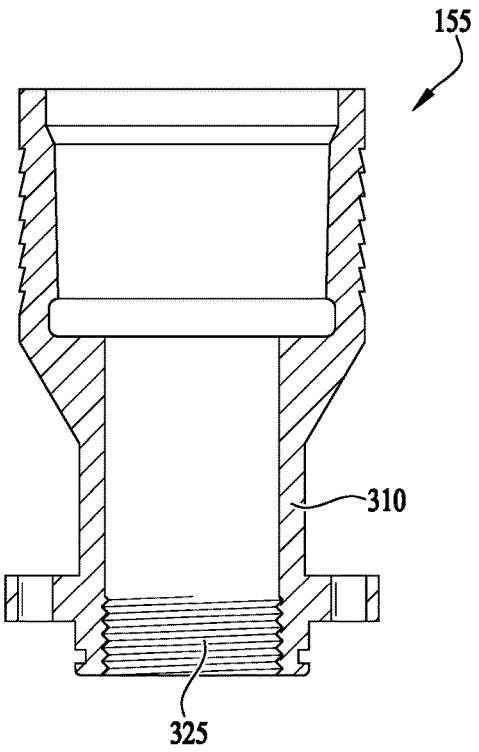
FIG. 4B is a cross sectional view across line 4B-4B of FIG. 4A of a pump discharge of an illustrative embodiment.
Figure 5A:
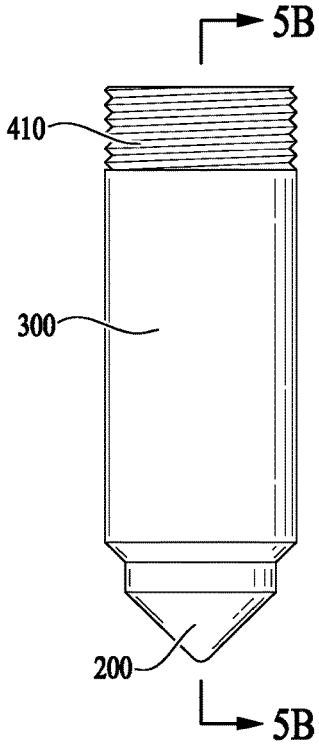
FIG. 5A is a perspective view of a nipple with blowout plug of an illustrative embodiment.
Figure 5B:
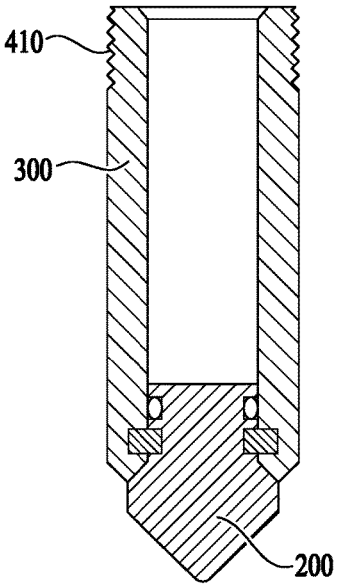
FIG. 5B is a cross sectional view across line 5B-5B of FIG. 5A of a nipple with blowout plug of an illustrative embodiment.
Figure 5C:
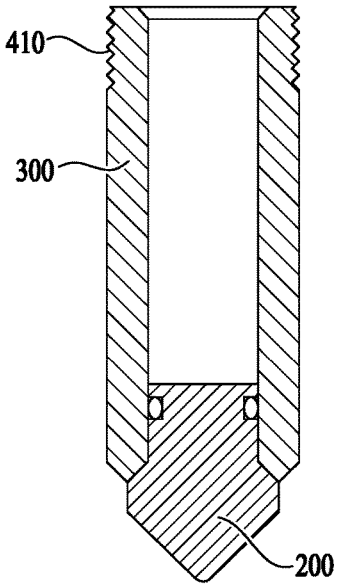
FIG. 5C is a cross sectional view of a nipple with blowout plug of an illustrative embodiment.

Pump discharge 155 may be a bolt-on discharge that connects and/or couples discharge adapter body 205 to the artificial lift pump, such as ESP multi-stage centrifugal pump 145. Discharge 155 may include bottom flange 405 with pattern to mate with pump 145 discharge end and/or pin up threading to match catcher housing 415. Blowout plug 200 may be secured over plug catcher 400 within nipple 300. Nipple 300 may be threaded and/or friction fit to pump discharge housing 310. Catcher 400 may prevent blowout plug 200 from falling into the wellbore once it is removed from a production blocking position. Top flange 420 of discharge 155 may mate with plug catcher 400 and/or nipple 300 with pin up threading and/or bolts. FIGS. 4A and 4B illustrate discharge 155 with threaded connection 325 to receive nipple 300. FIGS. 5A-5C illustrate blowout plug 200 and nipple 300 of illustrative embodiments. Nipple 300 may include nipple threads 410 to be threaded to discharge housing 415 and/or threaded connection 325. An o-ring may be employed to hold blowout plug 200 in place prior to over-pressuring. In some embodiments, as shown in FIG. 5B, shear pins may be used to attach blowout plug 200 to nipple 300 when blowout plug 200 is in the blocking position. Air, inert gas or fluids may be pumped down umbilical conduit system 150 to over-pressure blowout plug 200 to remove blowout plug 200 from the blocking position shown in FIG. 4A, the over-pressuring releasing blowout plug 200 into catcher 400 as shown in FIG. 4B.

Figure 6A:
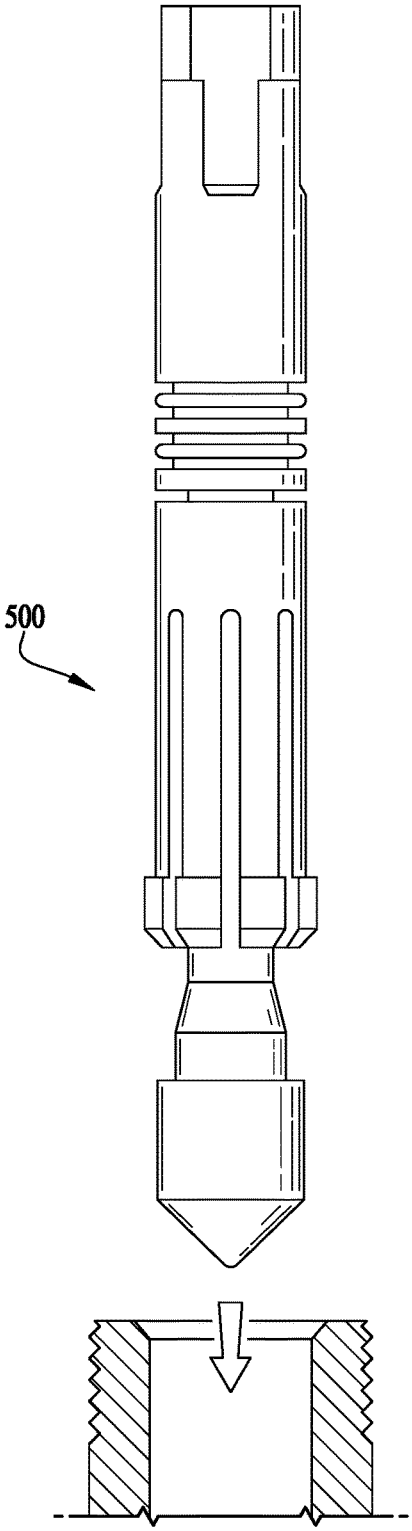
FIG. 6A is a perspective view of a dart of an illustrative embodiment in a run position.
Figure 6B:
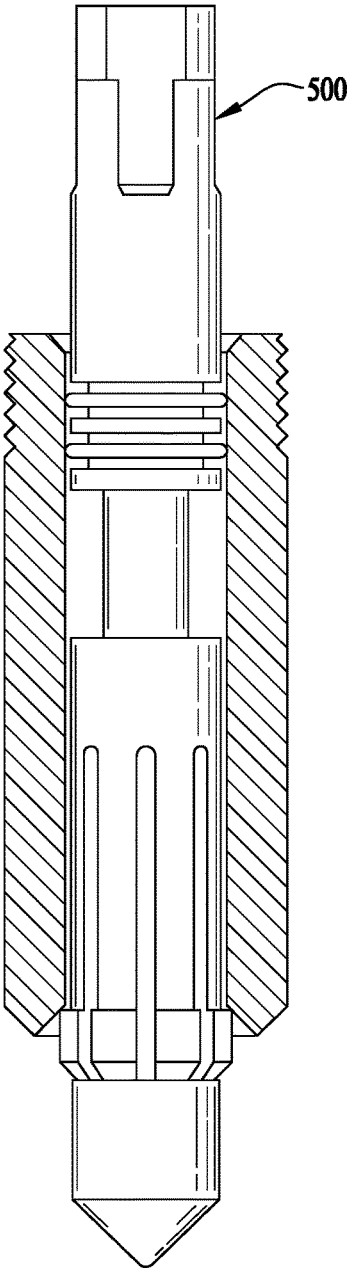
FIG. 6B is a perspective view of a dart of an illustrative embodiment in a set and seal position.

Drop dart may 500 isolate umbilical conduit system 150 during retrieval of pump assembly 100. FIG. 6A illustrates drop dart 500 in an extended, run position and FIG. 6B illustrates drop dart 500 in a set and sealed position. Drop dart 500 may be lowered into nipple 300 in an extended and/or run position, in preparation for retrieval of ESP assembly 500. Once positioned within nipple 300, drop dart 500 may be retracted to expand radially and be set and secured tightly within nipple 300. When in place within nipple 300, in the space vacated by blowout plug 200, drop dart 500 may block upward flow of production fluid and manage pressure during ESP assembly 100 retrieval.

Figure 7A:
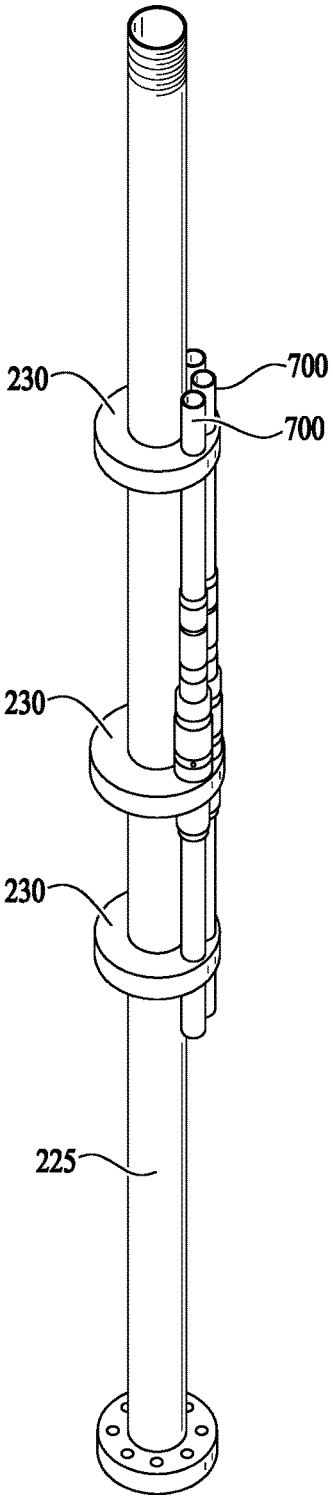
FIGS. 7A-7C illustrate perspective views of a discharge adapter body of an illustrative embodiment.
Figure 7B:
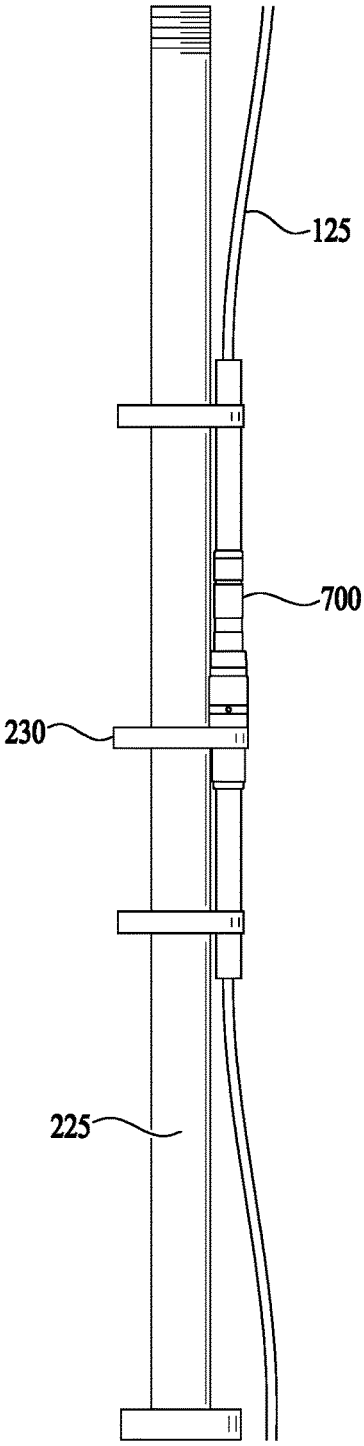
Figure 7C:
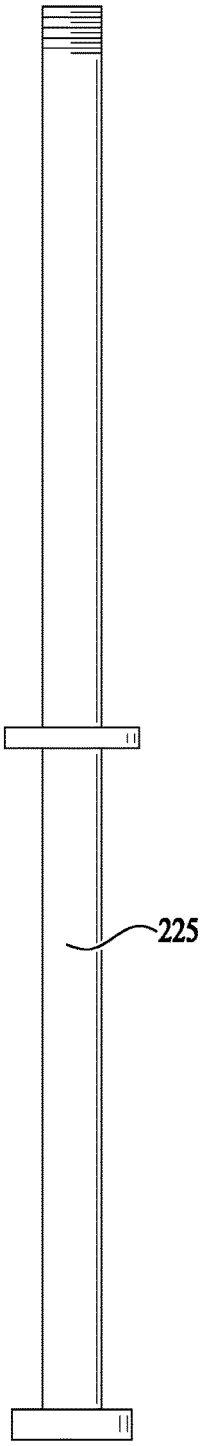
Figure 8A:
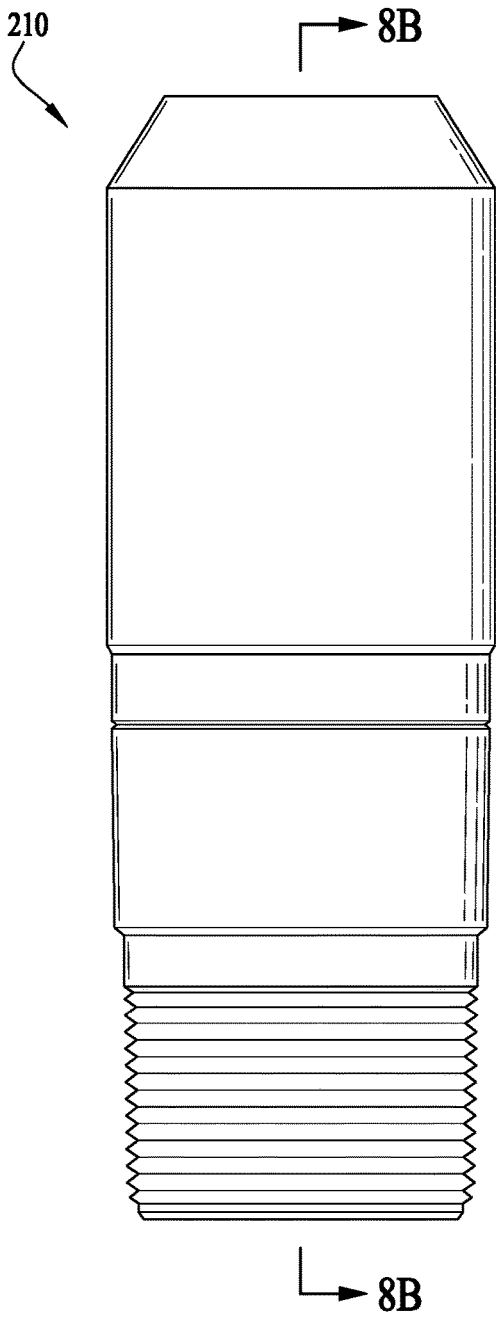
FIG. 8A is a perspective view of a grapple of an illustrative embodiment.
Figure 8B:
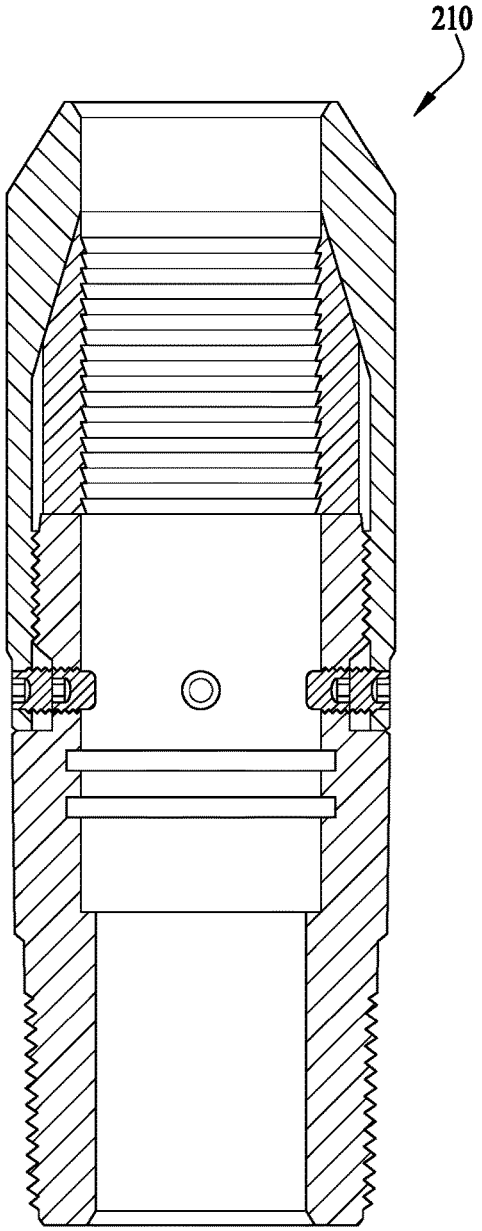
FIG. 8B is a cross sectional view across line 8B-8B of FIG. 8A of grapple of an illustrative embodiment.

FIG. 7A-7C illustrate discharge adapter body 205 of illustrative embodiments. Discharge adapter body 205 may include tubing and/or pipe 225, through which production fluid may flow. Power cables 125 may plug into electrical connectors 700 attached to the outside of pipe 225 with fasteners 230, which fasteners 230 may be clamps, bands, slips or another similar attachment mechanism. Electrical connectors 700 may provide protection to power cables 125 once jacket 235 terminates and may allow for an electrical connection in a confined space. Power cables 125 below electrical connectors 700, such as the motor lead extension between motor 120 and electrical connectors 700, may be smaller gauge cables than those above electrical connectors 700. Unlike power cables 125 above electrical connectors 700, power cables 125 near motor 120 (motor lead extension) and/or below electrical connectors 700 may have the benefit of being immersed in cooling well fluid. In some embodiments, for example in wider wells where space is not tight, power cables 125 extending from motor 120 may be spliced to power cables 125 inside umbilical 215, and electrical connectors may not be necessary. Grapple 210 may secure to the top of pipe 225 to create a seal between the inside of pipe 225 and coiled tubing 220. FIG. 8A and FIG. 8B. Illustrate an exemplary grapple 210.

Figure 9A:
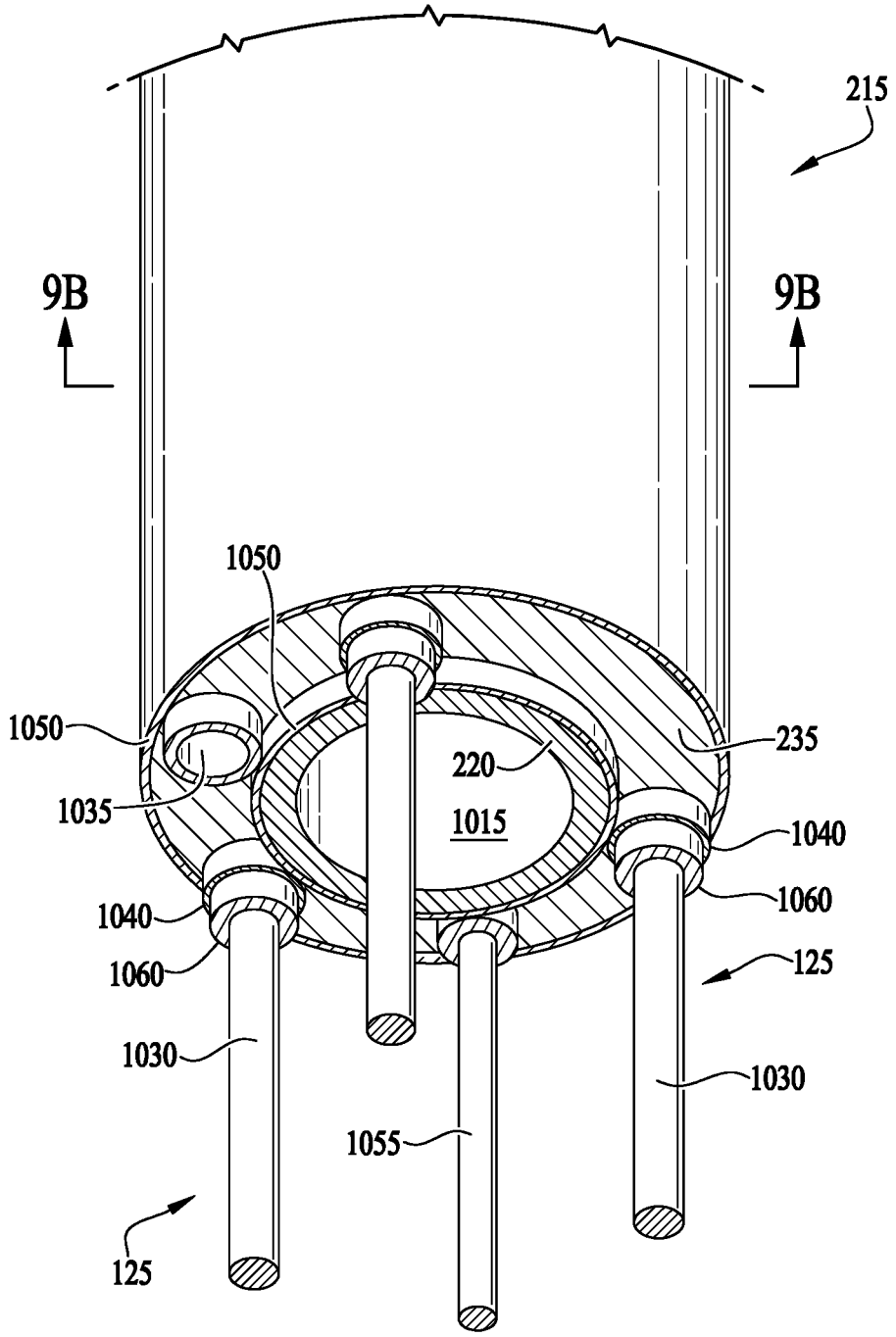
FIG. 9A is a perspective view of an umbilical of an illustrative embodiment.
Figure 9B:
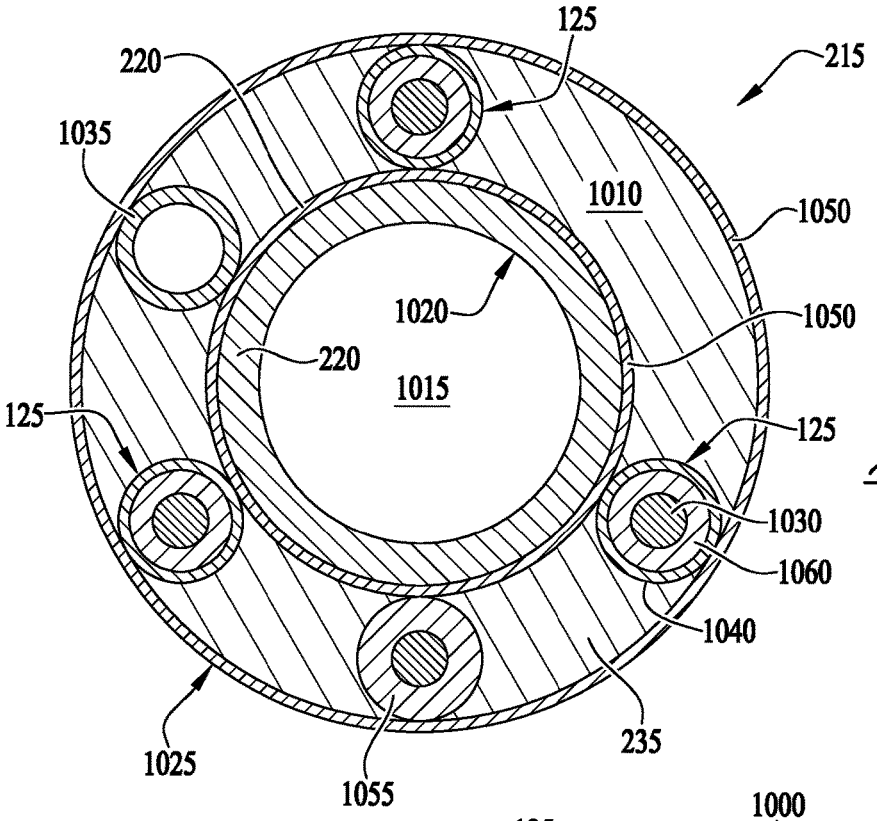
FIG. 9B is a cross sectional view across line 9B-9B of FIG. 9A of an umbilical of an illustrative embodiment.
Figure 9C:
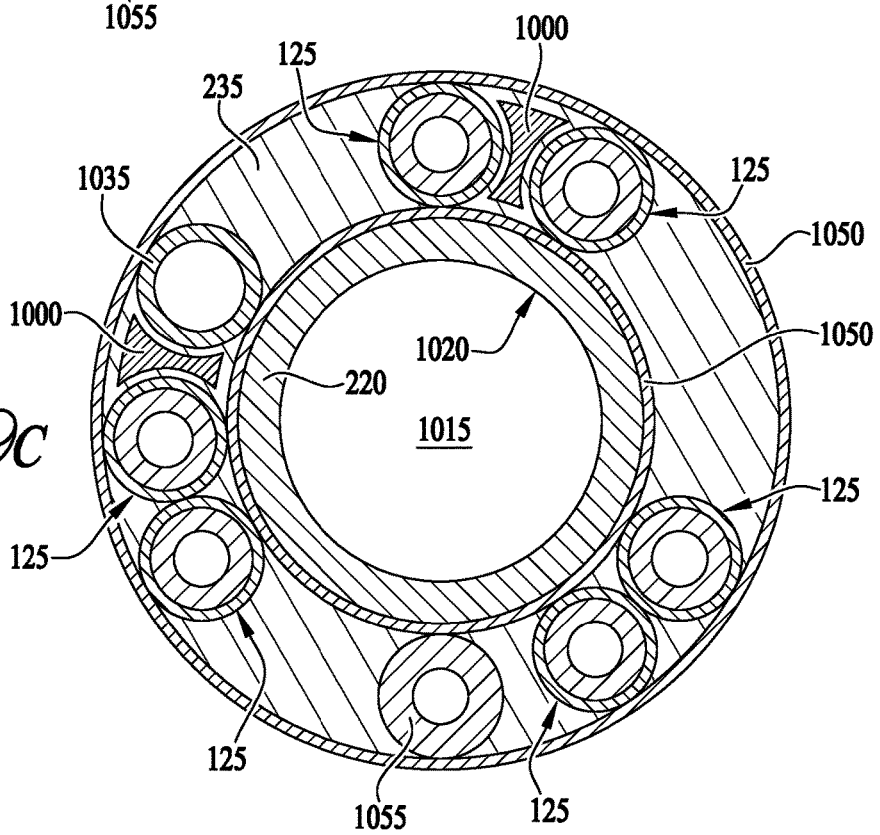
FIG. 9C is a cross sectional view of an umbilical of an illustrative embodiment.

FIGS. 9A-9C show an umbilical of illustrative embodiments. Umbilical 215 may be long enough to extend from wellhead 160 to grapple 210. ESP assembly 100 may be placed at a pump setting depth of 1,000 to 1,500 meters, and operated by an artificial lift motor 120 having 50-60 horsepower (hp). In one illustrative example, umbilical 215 may be 1,500 meters in length or longer. Although ESP assembly 100 may extend up to 4,000 meters deep within a well, shorter length assemblies with higher operating speeds, may be employed in lieu of longer strings to accommodate crane height, and limit the weight over deeper wells. In wells deeper than about 5,000 feet and hotter than about 150° F., the risk that injector 2105 (shown in FIG. 21) may deform jacket 235 increases. To combat this risk and to enable use of illustrative embodiments in wells longer than 5,000 feet deep, ribs 1000 may be placed into jacket 235 between conductors to support pressure from injector 2105, as illustrated in FIG. 9C.

The well, for example, may include a 5.5 inch diameter well bore. In such an example, umbilical 215 may have a 2⅜ inch overall outer diameter 1025 and may include coiled tubing 220 surrounded by jacket 235. Jacket 235 may include polypropylene and/or high density polyethylene inner and outer walls 1050 that are filled with carbon fiber 1010. Coiled tubing 220 may be made of low-alloy steel coil tubing, such as 80 kpsi grade steel, and in this example have a coiled tubing outer diameter 1025 of about 1.5 inches. Since power cables 125 are extruded inside jacket 235, umbilical 215 outer diameter 1025 may be uniform without any protrusions resulting from power cables, cable clamps, bands or fasteners. Inner diameter 1020 of umbilical 215 may be sized for the desired flow rate, such as for example a one inch inner diameter for a flow rate of 1,000 bpd. Production fluid 450 may flow through central opening 1015 of umbilical 215, defined by umbilical inner diameter 1020, during pump operation.

Rather than being attached to the outside of umbilical 215, power cables 125 for the artificial lift motor 120 may be extruded and/or embedded inside jacket 235 of umbilical 215, such as inside carbon filling 1010 of jacket 235. Coil tubing 220 may be placed in planetary device to lay in helical manner the ESP power cable 125 conductors 1030 along with associated wiring such as ground wire 1055 or instrument wire and capillary tube(s) 1035. This assembly is then placed in an extruder to add outer jacket wall 1050 material that fills all the void area, allowing umbilical 215 to be sealed when traversing a pressure window at deployment into a production well. Jacket 235 may be bounded by polypropylene and/or high density polyethylene walls 1050, or walls 1050 of another plastic, thermoplastic or other material with similar properties. Inner wall 1050 may protect cabling (conductors 1030, I-wire and/or capillary tube 1035) and outer wall 1050 may allow umbilical 215 fit injector 2105. Coiled tubing 220 may be a supportive structure that supports artificial lift assembly 100 and umbilical conduit system 150 hanging in the well, as production fluid 450 passes through central opening 1015 of coiled tubing 220 during operation.

As shown in the embodiment of FIGS. 9A-9C, umbilical 215 includes three power cable 125 phases for an artificial lift assembly having a three-phase motor 120, such as a two-pole, three-phase, squirrel cage induction motor 120. In the example of FIGS. 9A-9B, one power cable 125 is shown for each phase. As such, three power cables 125 are shown extruded within jacket 235 of umbilical 215. In FIG. 9C, each phase is split into two power cables 125, and six power cables 125 are shown. In another example, each phase may be split into three power cables 125, and nine power cables 125 may be dispersed within jacket 235. Power cables 125 may, for example, include copper or aluminum conductors 1030 inside ethylene propylene diene monomer (EPDM) or similar insulation 1060. Insulation 1060 of power cable 125 may be further surrounded by lead sheath 1040. Ground wire 1055, which may be a solid copper wire, and/or capillary line 1035, if needed, may similarly be extruded inside jacket 235 of umbilical 215. Capillary line 1035 may serve to carry chemicals down into the well bore, if desired.

Referring to FIG. 9C, in deeper wells where umbilical 215 needs to be of longer length, ribs 1000 may be added between conductors to support pressure from injector 2105. Ribs 1000 may be polyether ether ketone (PEEK), epoxy and/or carbon fiber reinforced, and provide additional support for longer umbilical 215 lengths, such as lengths of 5,000 feet or longer and/or hotter well temperatures such as temperatures above 150° F.

Figure 10:
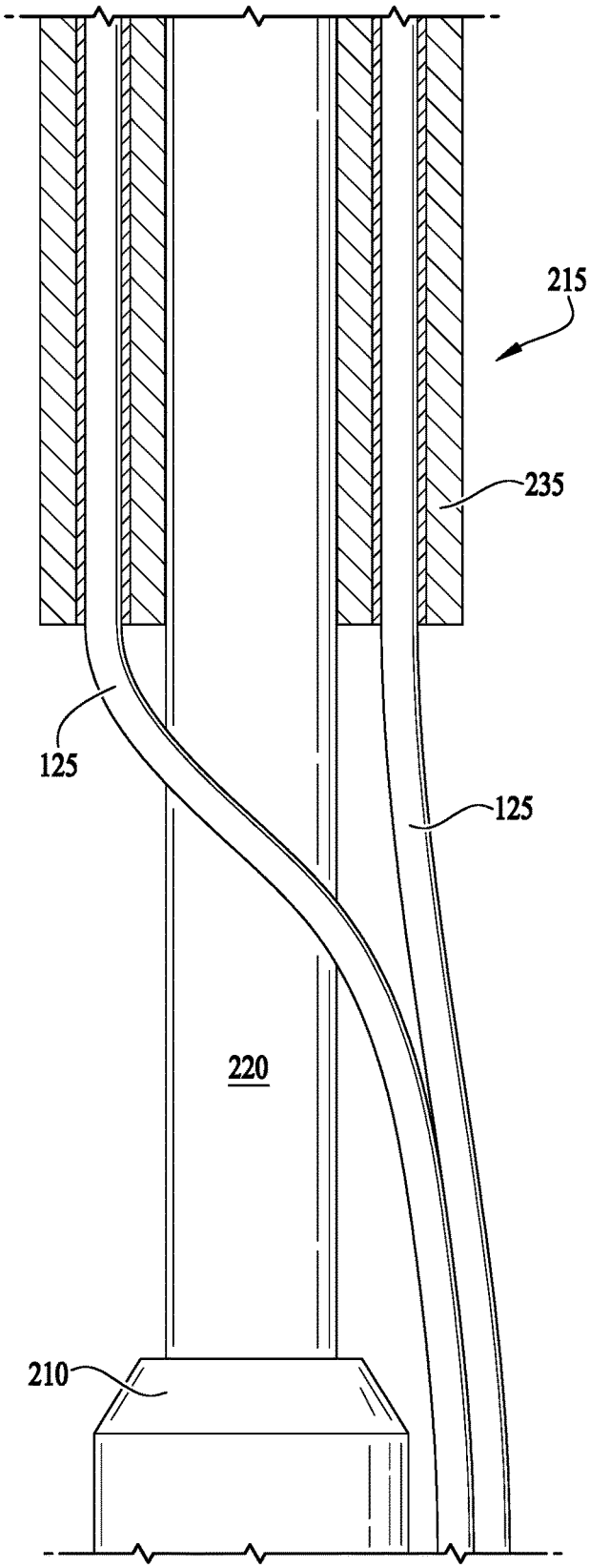
FIG. 10 is a perspective view a connection between a grapple and an umbilical of illustrative embodiments.

Power cables 125 may extend the length of umbilical 215 inside jacket 235 and may break out above seals at the top and bottom of umbilical 215 to connect to power source 170 on one side and motor lead extension and/or motor 120 on the other side. FIG. 10 illustrates power cables 125 breaking out of umbilical 215 towards grapple 210, discharge adapter body 205 and/or electrical connectors 700. Grapple 210 may be attached to the end of coiled tubing 220 without restricting inner diameter 1020 of coiled tubing 220. Grapple 210 may grip outer diameter of coiled tubing 220 to evenly distribute compressive forces.

Figure 11:
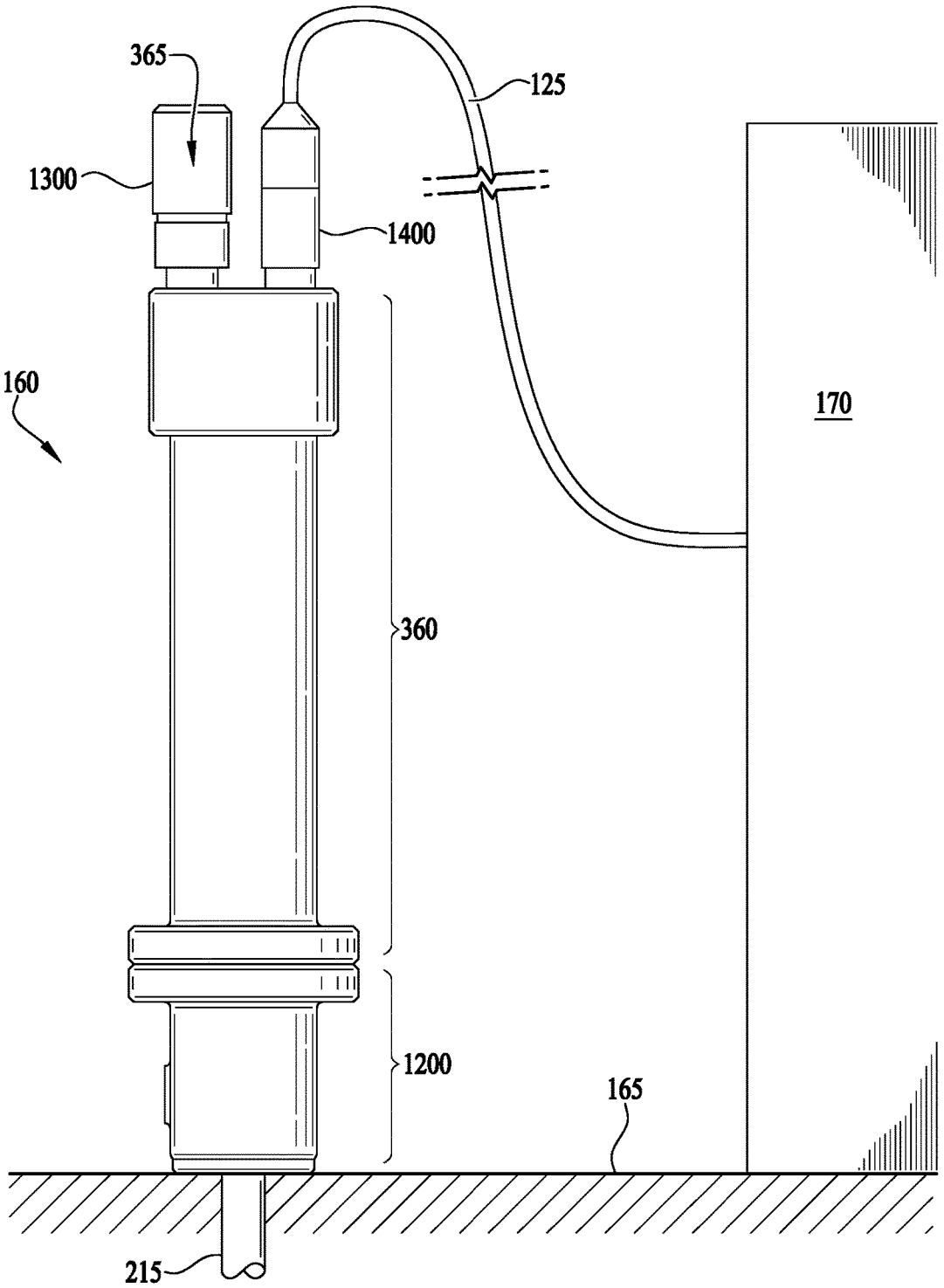
FIG. 11 is a perspective view of a wellhead of an illustrative embodiment after well completion.

Umbilical conduit system 150 may hang from hanger 1200 of wellhead 160. FIG. 11 illustrates a wellhead 160 of illustrative embodiments hanging an installed umbilical 215. A completed wellhead 160 may include hanger section 1200 and bonnet 360. Power cables 125 may exit through the top of bonnet 360 and plug into power source 170. Umbilical terminus 365 may be connected to surface pipes and/or storage tanks to carry production fluid 450 travelling inside coiled tubing 220 to storage or a processing or distribution system.

Figure 12A:
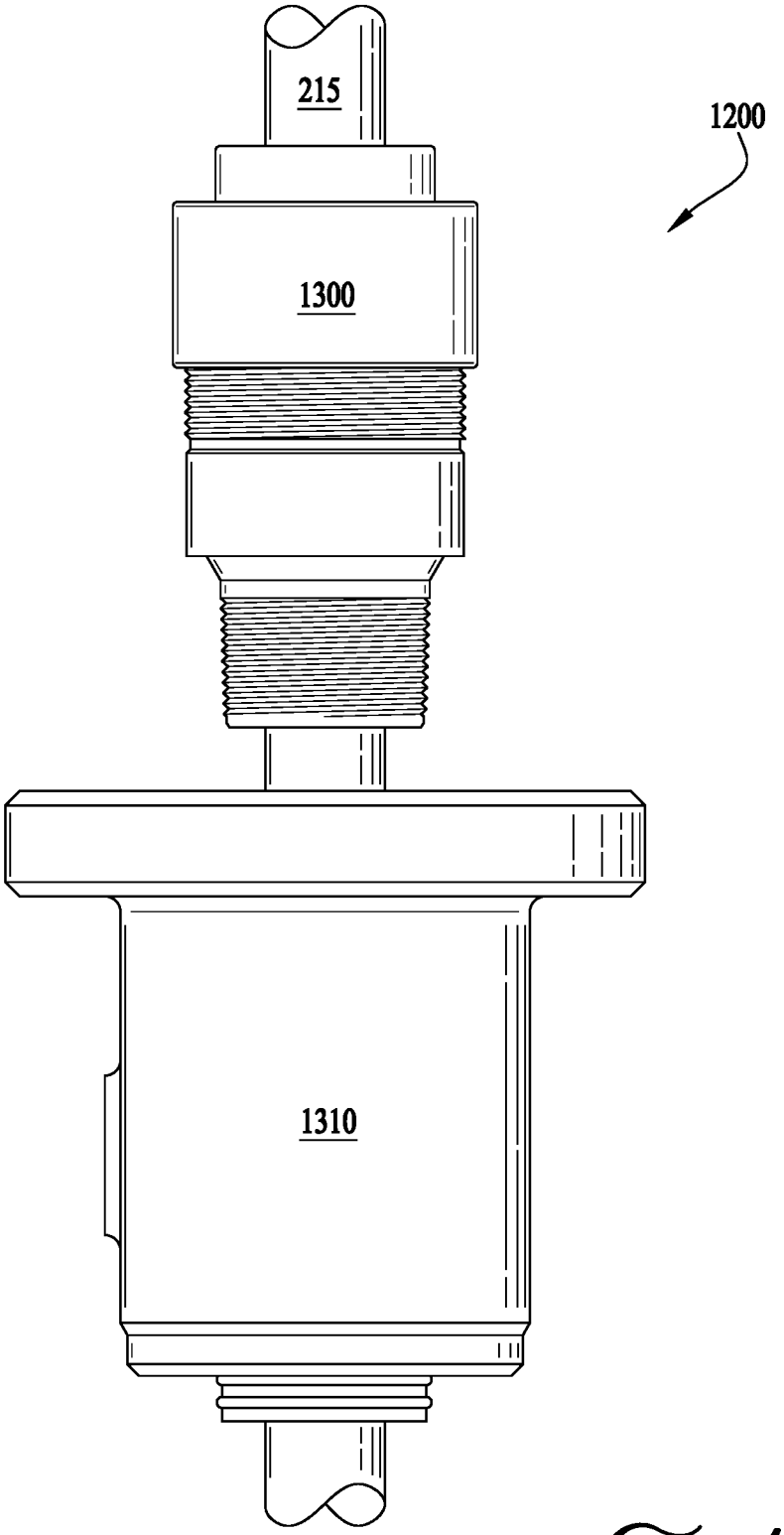
FIG. 12A is a perspective view of a wellhead hanger assembly of an illustrative embodiment.
Figure 12B:
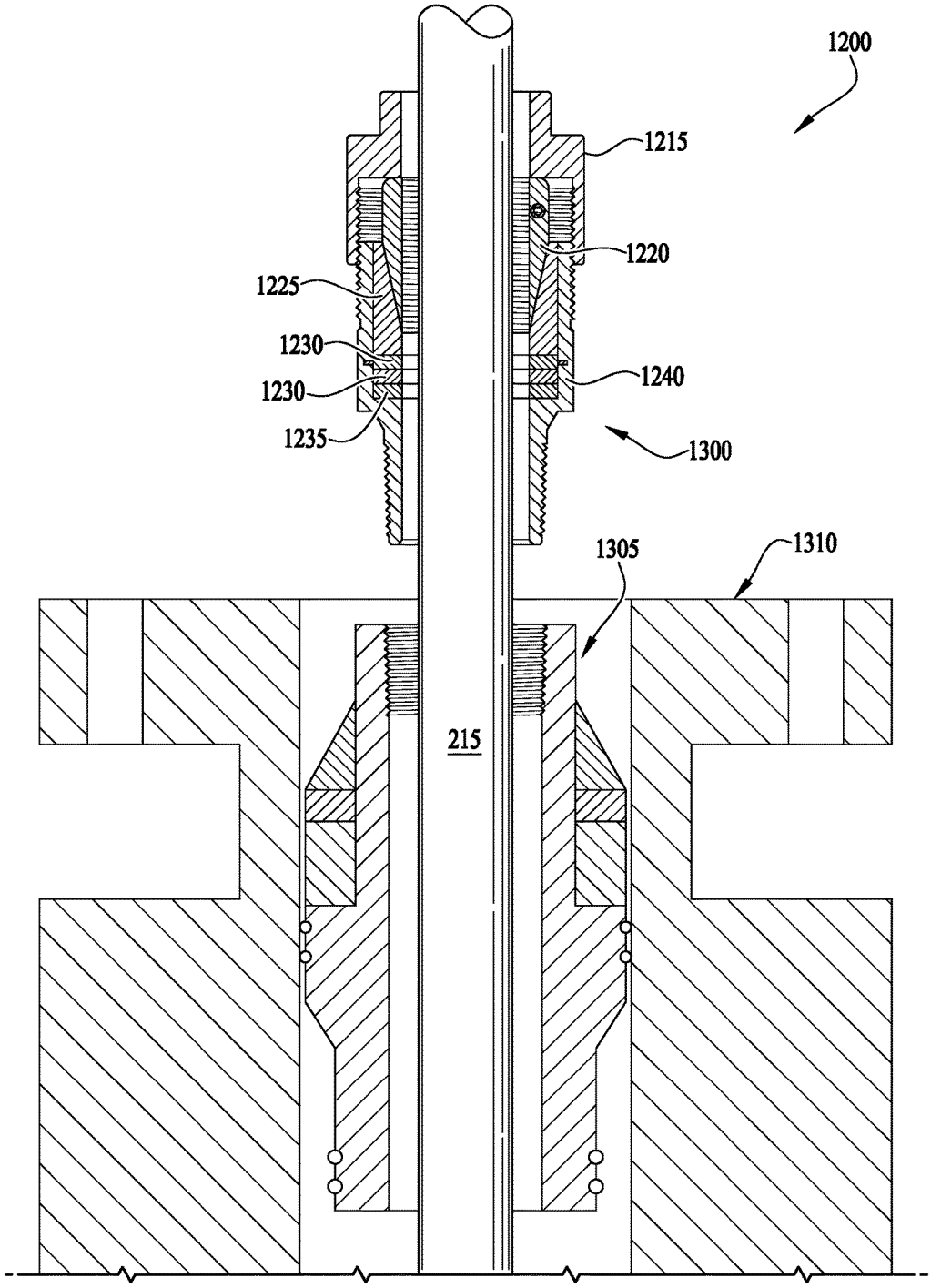
FIG. 12B is a cross sectional view of a wellhead hanger assembly of an illustrative embodiment.
Figure 13:
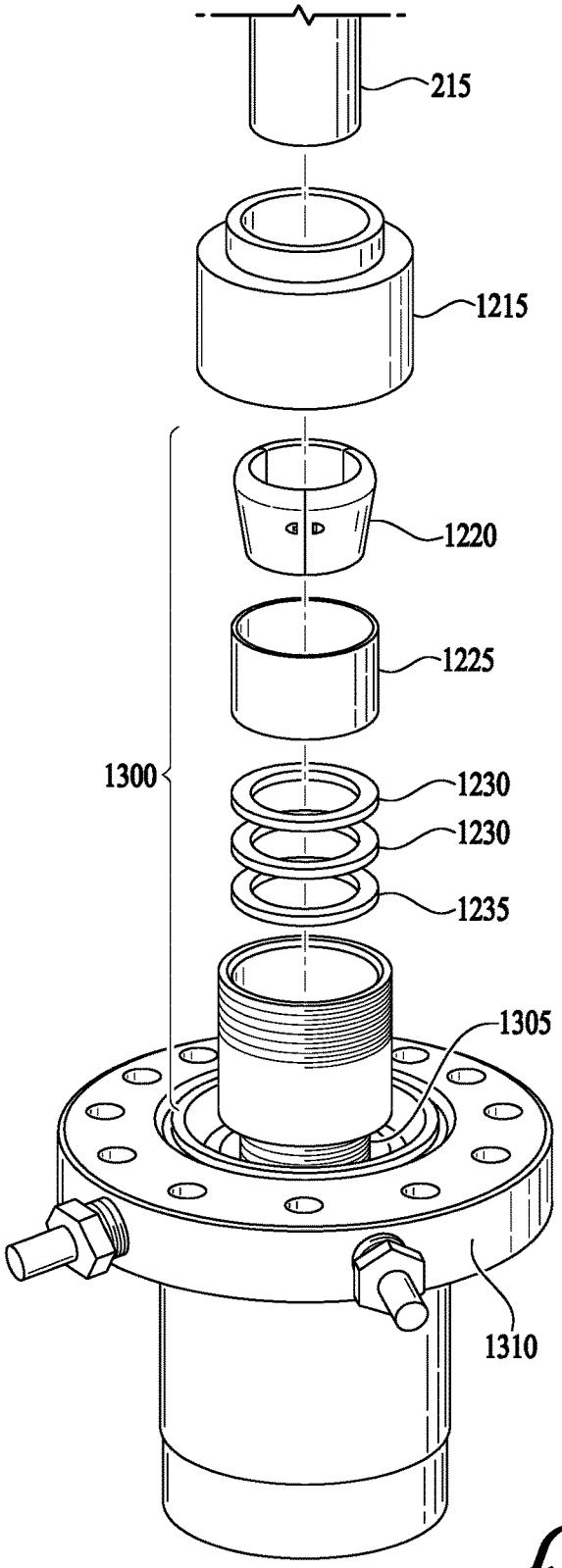
FIG. 13 is an exploded view of a wellhead hanger of an illustrative embodiment.
Figure 14:
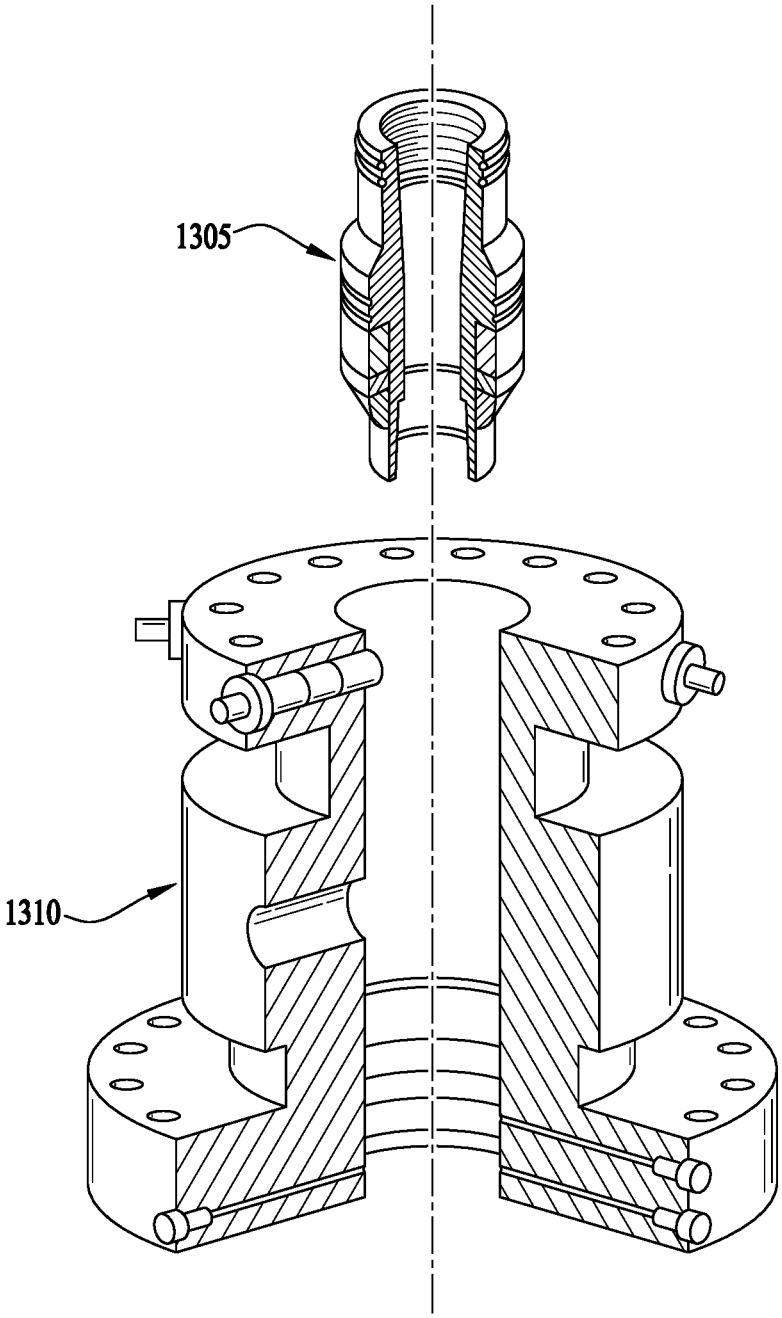
FIG. 14 is a perspective view of a tubing head spool and tubing hanger of an illustrative embodiment.

Hanger section 1200 may include tubing hanger 1305 surrounding umbilical hanger 1300, with both tubing hanger 1305 and umbilical hanger 1300 landed in tubing head spool 1310. FIGS. 12A-12B and FIG. 14 illustrate hanger section 1200 of illustrative embodiments including tubing hanger 1305 and umbilical hanger 1300. Umbilical hanger 1300 may include locking cap 1215, slips 1220, slip guide 1225, seal elements 1230, and retainer ring 1235 that compress umbilical 215 inside umbilical hanger body 1240. FIG. 13 illustrates an exploded view of umbilical hanger 1300, with umbilical hanger 1300 threaded to tubing hanger 1305 inside of tubing head spool 1310. Coiled tubing 220 may extend centrally through umbilical hanger 1300 with slips 1220 pressing into umbilical 215. Weight of the equipment string, including umbilical conduit system 150 and ESP assembly 100, pulls downwards on the compressive hanger section 1200, thereby providing well control through the weight of the string squeezing on the umbilical 215, and also supporting, holding and/or hanging umbilical conduit system 150 and ESP assembly 100 in the well. Retaining rings 1235 may prevent deformation of umbilical 215 and/or umbilical hanger 1300. Once umbilical extends through hanger section 1200, umbilical 215 may be sealed below hanger section 1200, and umbilical 215 may be stripped to separate coiled tubing 220, power cables 125, capillary tube 1035 and/or ground cable 1030. A second umbilical hanger 1300 may be installed at the umbilical terminus 365 to provide a redundant seal. Once umbilical is installed in hanger section 1200, blowout preventers and/or annular bag 1205 may be removed since well control is established. An electrical feedthrough 1400 (shown in FIG. 11) may guide power cables 125 as they break out of the top of jacket 245 and extend through and out wellhead 160.

Figure 15:
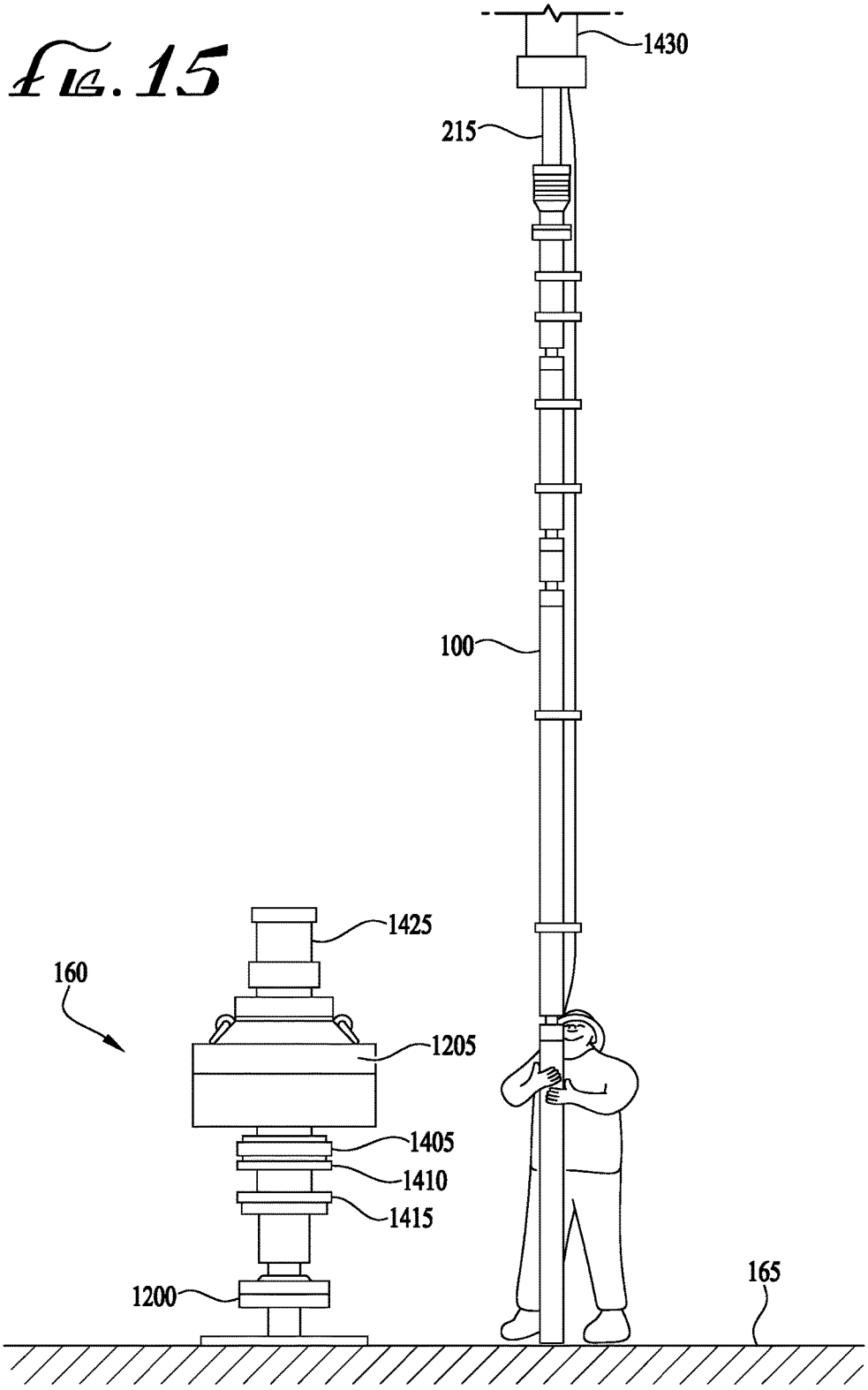
FIG. 15 is a perspective view of a wellhead with blowout preventer stack of an illustrative embodiment during live well completion.
Figure 16:
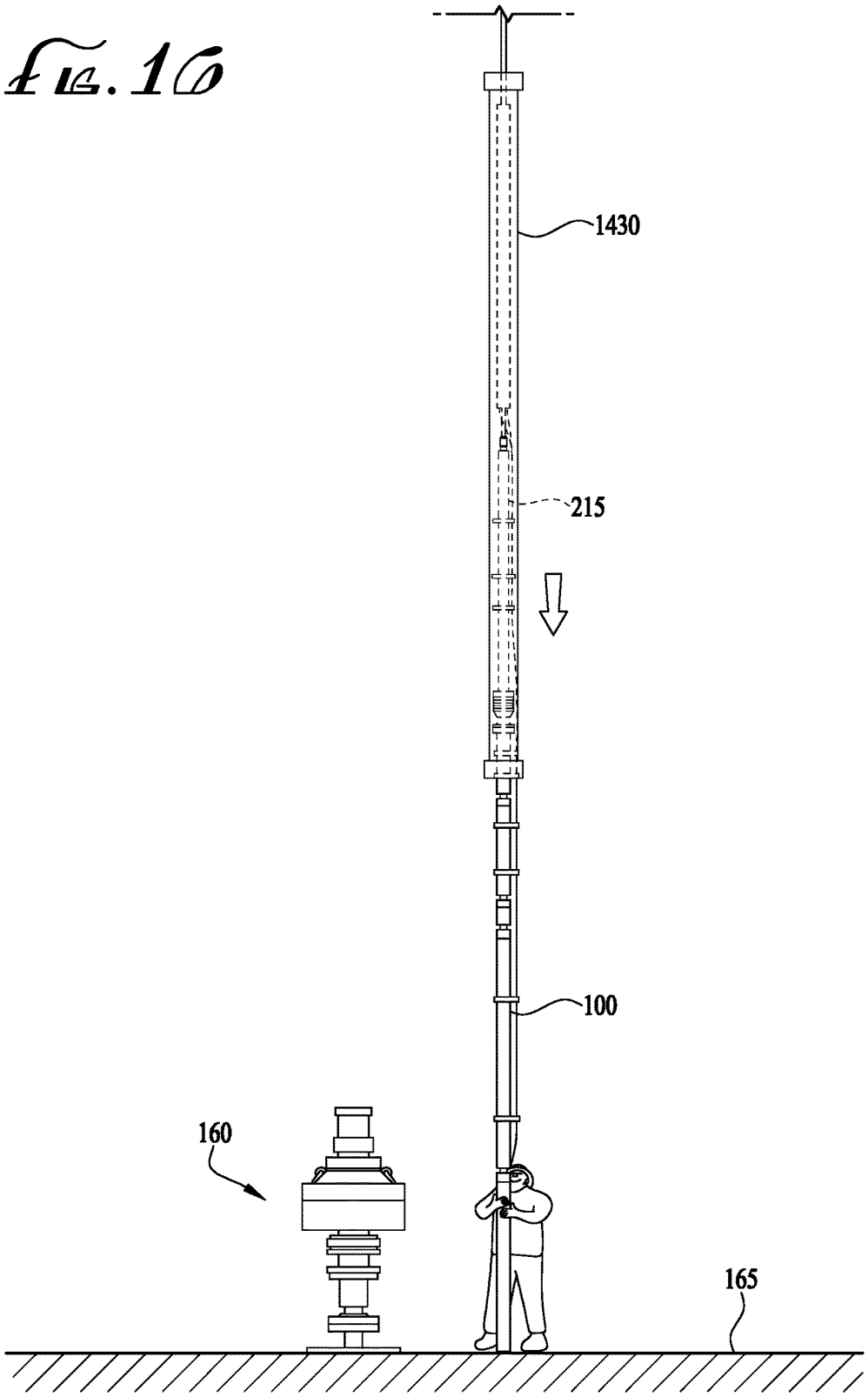
FIG. 16 is a perspective view of pulling an ESP pump into a lubricator during live well completion of an illustrative embodiment.
Figure 17:
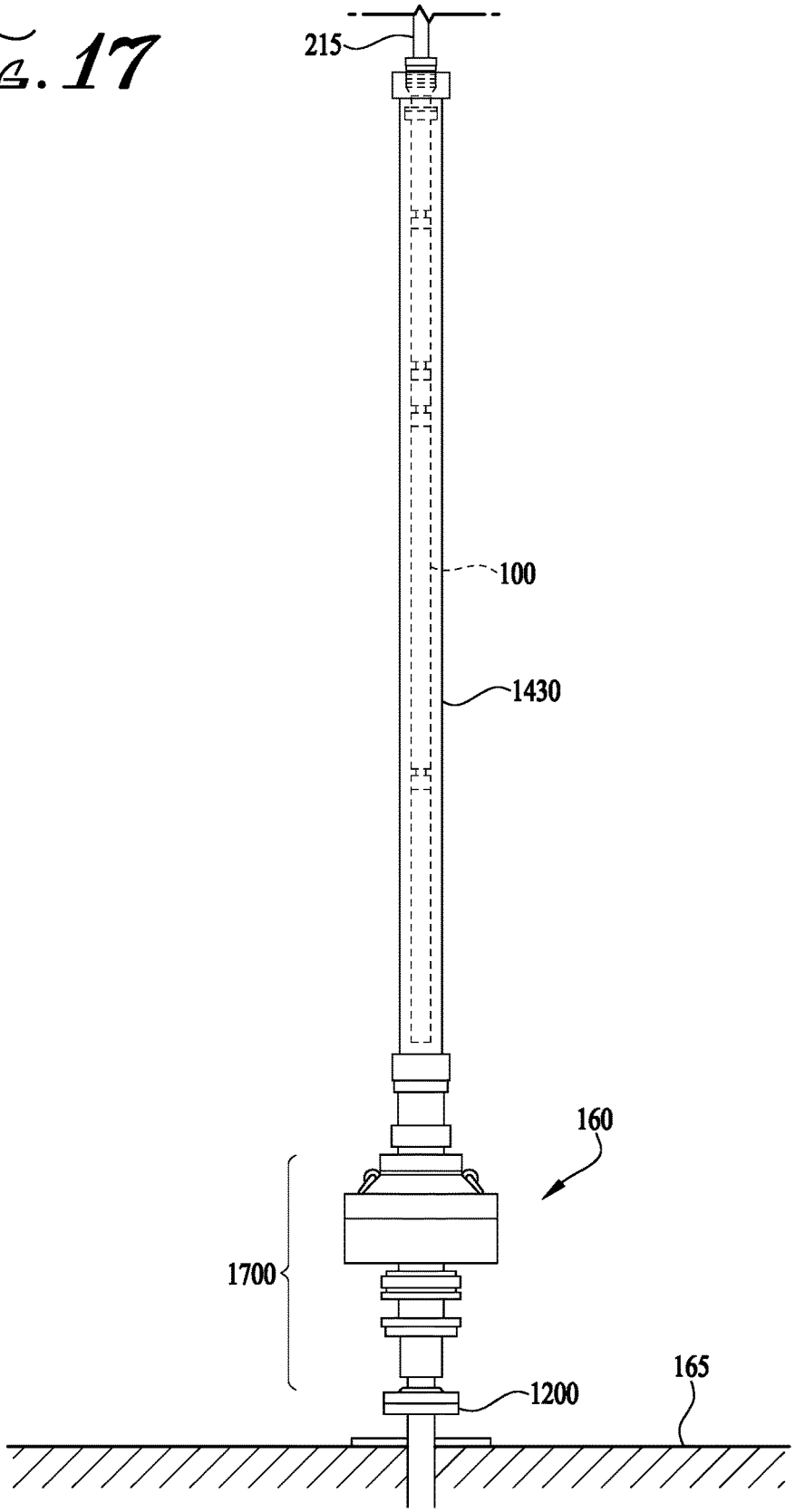
FIG. 17 is a perspective view of landing a lubricator on a blowout preventer stack of an illustrative embodiment during an exemplary live well completion method of illustrative embodiments.
Figure 18:
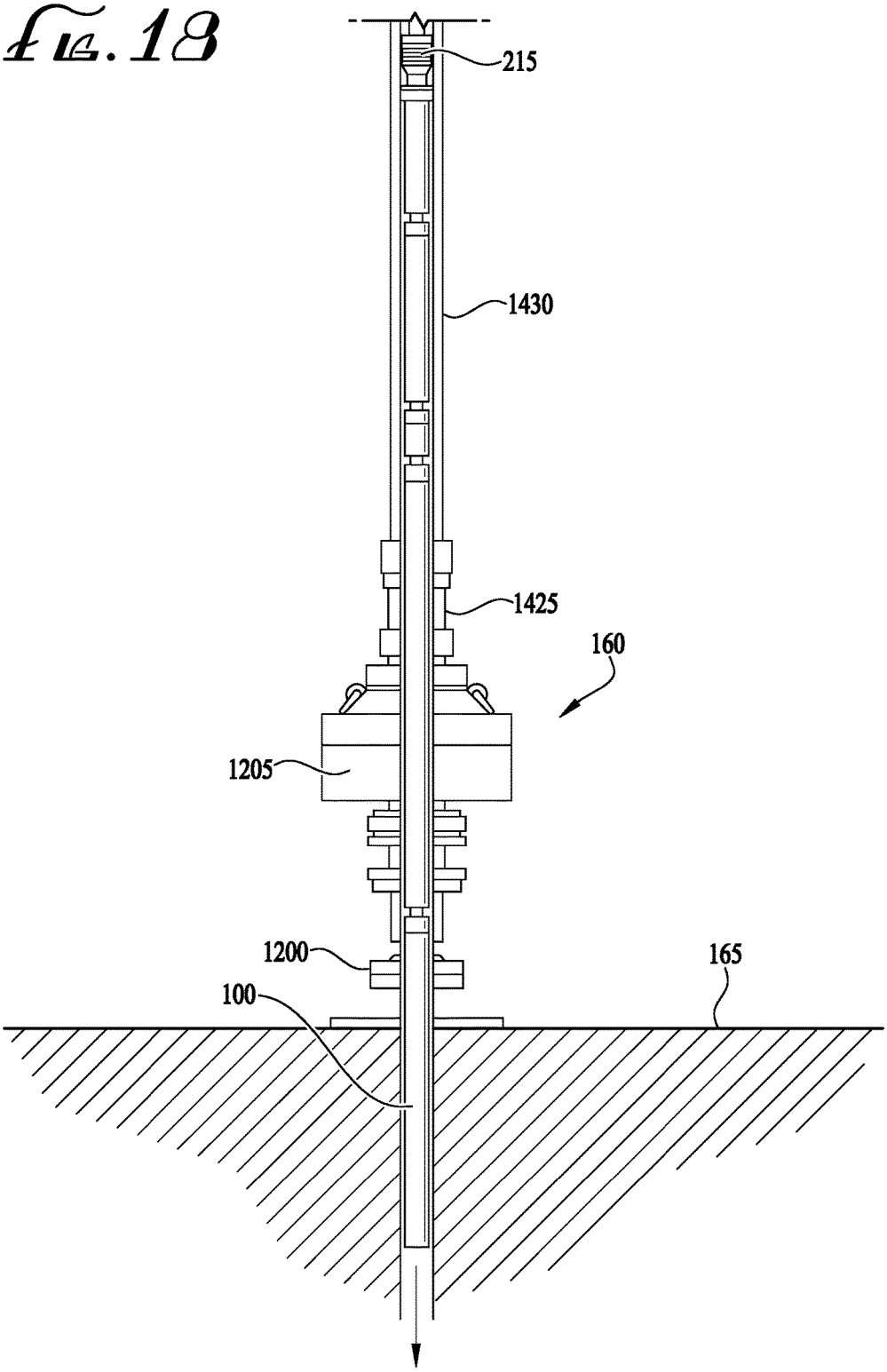
FIG. 18 is a perspective view of running in hole of an illustrative embodiment during an exemplary live well completion method of illustrative embodiments.

During live well completion, an annular bag may maintain annular pressure between well casing 105 and umbilical 215. FIG. 15 illustrates wellhead 160 with annular bag 1205 as ESP assembly 100 is being pulled into lubricator 1430 during a live well completion. Wellhead 160 may include hanger section 1200 and annular bag 1205. Pipe rams 1405, blind rams 1410 and choke and kill lines 1415 may extend between hanger section 1200 and annular bag 1205. Work window 1425 may sit above annular bag 1205. When energized, annular bag 1205 may provide well control prior to umbilical 215 hanging procedures. Well control provide by annular bag 1205 may allow window 1425 to be opened and hanger section 1200 and umbilical 215 installed, as well as the stripping off of lubricator 1430. Elastomeric seal 1230 may provide a seal below annular bag 1205. Annular bag 1205 may be a bag-type blow out preventer and include a wear plate, packing unit, head, opening chamber, piston and closing chamber. Window 1425 may provide a secure access point to umbilical 215 while ensuring safe procedures and secondary well control, while wellhead 160 carries the weight of injector head 2105, umbilical conduit system 150 and artificial lift assembly 100. Annular bag 1205 may include a rubber sleeve or elastomeric bag that inflates and seals around umbilical 215. Wellhead 160 with annular bag 1205 and hanger section 1200 may serve a dual function of both hanging and supporting umbilical 215 and sealing the annular space between umbilical 215 and the well casing 105. FIG. 16 illustrates ESP assembly 100 continuing to be pulled into lubricator 1430. FIG. 17 illustrates lubricator 1430 landed on blowout preventer stack 1700 consisting of annular bag 1205, pipe rams 1405, and blind rams 1410. Pressure may be equalized during lubricator 1430 landing by slowly opening annular bag 1205. FIG. 18 illustrates running in hole slowly at about one to two meters per minute to allow tubing hanger 1205 to seat in tubing head spool 1210.

Illustrative embodiments may be employed in new artificial lift applications or existing applications. In the instance of an existing application, any conventional production tubing may be pulled from the assembly and replaced with umbilical conduit system 150 of illustrative embodiments, and a conventional wellhead and discharge may be modified with the improvements described herein to obtain wellhead 160 with umbilical hanger 1300 and discharge 155. An existing wellhead may be retrofit to utilize an existing wellhead and tubing hanger. Illustrative embodiments may employ double or triple redundant seals to maintain safety and complete pressure control.

Figure 19:
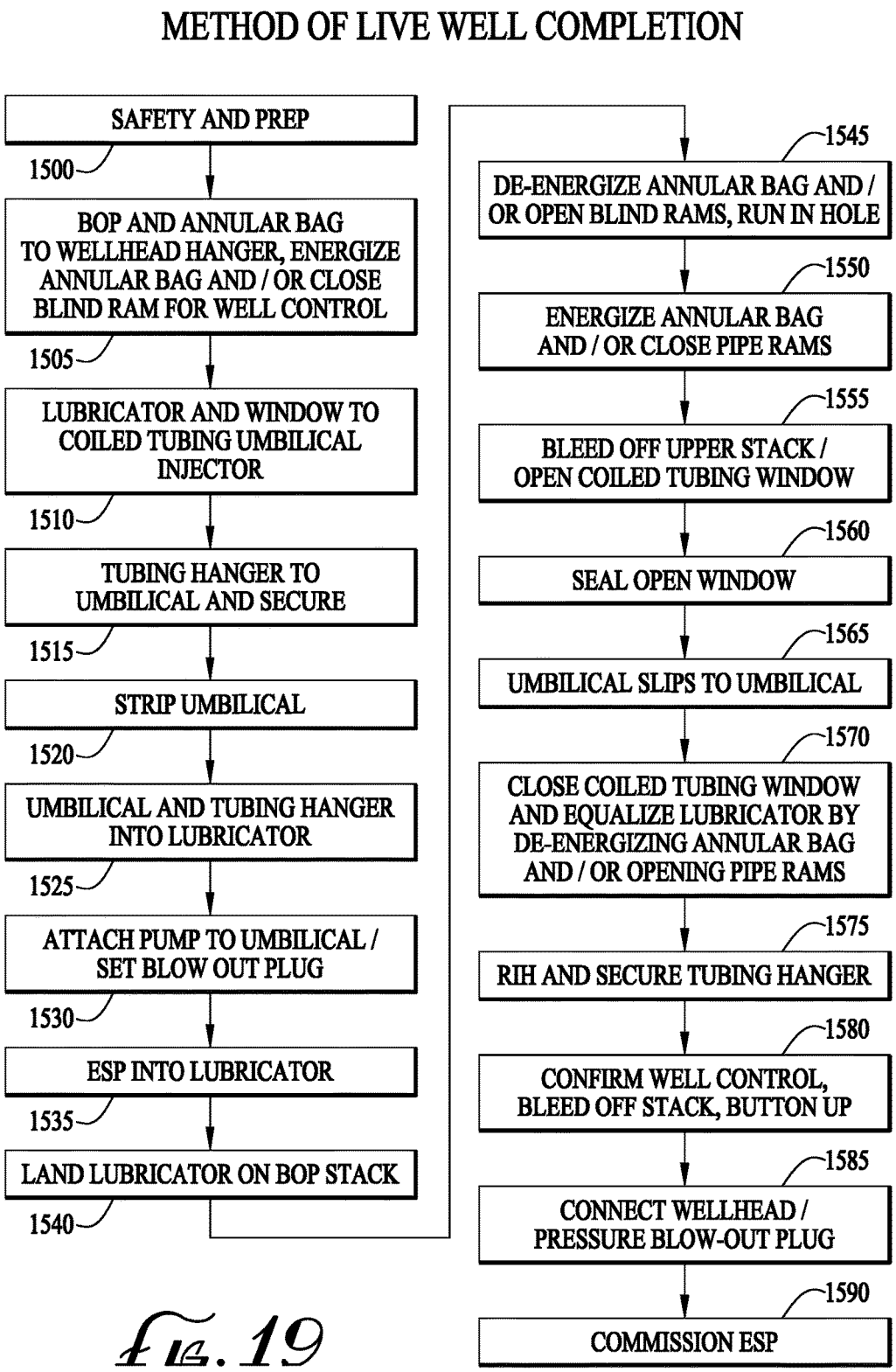
FIG. 19 is a flowchart of a method of live well completion of illustrative embodiments.

Illustrative embodiments include a method of live well artificial lift completion. FIG. 19 illustrates a method of live well completion of illustrative embodiments. At preparation step 1500, a safety meeting may be conducted, and job parameters, well class, and any safety issues that may arise may be discussed. For example, potential danger areas may be identified and equipment may be spot on location. Coiled tubing rig 2100 (shown in FIG. 21) may be spot at the wellhead, wellhead height may be factored and lubricator 1430 and window 1425 above blow out preventers (BOP) 1700 may be accounted for. Well pressures may be checked and recorded. Hanger section 1200 may be checked to ensure hanger section 1200 is proper for the job. At step 1505, BOP 1700 and/or annular bag 1205 may be function tested and then bolted onto hanger 1200. Annular bag 1205 may be energized and/or blind rams 1410 may be closed for well control. At step 1510, the lubricator 1430 and window 1425 may be attached to coiled tubing rig injector 2105. Connections may be pressure tested with pump and sub. At step 1515, umbilical hanger 1300, such as a 2⅞"×3½" coiled tubing hanger less cap 1215 and slips 1220 may be threaded into 7 1/16"×3½" tubing hanger 1305 then both hangers 1300, 1305 may slide onto umbilical 215, which may for example be a 2⅞" coiled tubing 220 umbilical. Umbilical 215 may be secured with a C-clamp above where discharge adapter body 205 will be installed. At umbilical stripping step 1520, umbilical 215 may be stripped to expose power cables 125 by removing power cables 125 from jacket 235 on the stripped portion of umbilical 215. At step 1525, pump assembly 100 may be brought to vertical beside well bore and umbilical 215 and tubing hanger 1305 assembly may be pulled into lubricator 1430, leaving stripped end of umbilical 215 exposed.

At pump attachment step 1530, ESP assembly 100 may be attached to umbilical 215, ensuring blowout plug 200 and/or dart 500 is functional and in place. Grapple 210 may be connected to coiled tubing 220 and discharge adapter body 205. Capillary tube 1035, which may for example be a ⅜ inch capillary tube may be connected to either a check valve for injection or a subsurface safety valve. Motor lead extension conductors may be connected to power cables 125 on discharge adapter body 205, and discharge adapter body 205 may be attached to pump discharge 155. Blow out plug 200 may be set in a blocked position. At step 1535, ESP assembly 100 may be pulled up into lubricator 1430. At step 1540, the lubricator/riser 1430 may land on BOP stack 1700, which BOP stack 1700 may include annular bag 1205, pipe rams 1405 and blind rams 1410. BOP stack 1700 may also be pressure tested. Pressures may be set for in-hole/out-hole and skate grip on injector 2105. At step 1545, BOP stack 1700 may be equalized with wellbore pressure by slowly opening annular bag 1205 and/or opening blind rams 1410. Umbilical conduit system 150 with attached ESP assembly 100 may then be run in hole slowly at one to two meters per minute to allow tubing hanger 1305 to seat and seal in tubing head spool 1310. The assembly may be run in hole to desired depth. Run in hole speed may be increased to a maximum of fifteen meters per minute. Care should be taken avoid tagging of collars. Coil tubing rig may be set to have minimum push on ESP assembly 100.

Once set pump depth has been achieve, annular bag 1205 may be energized and pipe rams 1405 may be engaged (closed) if required in order to isolate the annulus, at step 1550. At step 1555, the upper stack may be bled off and once pressure is atmospheric, the coiled tubing window 1425 may be opened. At step 1560, with coiled tubing window 1425 open, a rubber seal may be placed inside the bottom of the window to prevent any debris from falling into the well bore. At step 1565, umbilical slips 1220 may be installed on umbilical 215 maintaining an even distance between the three slip 1220 segments while tightening up with an Allen wrench to specified torque. Locking cap 1215 may be slid on and be secured with a small clamp. At step 1570, coiled tubing window 1425 may be closed, annular bag 1205 de-energized and/or pipe rams 1405 opened to equalize lubricator 1430 pressure with the well bore. At step 1575, slips 1220 may be run in hole slowly at about one to two meters per minute and landed on tubing hanger 1305. Once tagged, lockdown screw lags maybe tightened on tubing head spool 1310 to secure tubing hanger 1305. At step 1580, well control may be confirmed, BOP stack 1700 may be bled off and pressures monitored to ensure well control and that seals on tubing hanger 1305 are maintaining well control barrier and backside pressure is stable. Window 1425 may be open and coil tubing 220 cut. Lubricator 1430, window 1425, BOP stack 1700 and coiled tubing injector 2105 may be removed and wellhead 160 buttoned up. At step 1585, wellhead 160 may be connected as per customer specifications and procedures. Interior of coiled tubing 220 may be over-pressurized within umbilical 215 to blow out plug 200, allowing flow up of production fluid 450 up interior of coiled tubing 220 to flow line. At step 1590, ESP assembly 100 may be commissioned.

Illustrative embodiments include an umbilical hanging method that provides for live well completion with complete well control and/or sealing of wellhead 160. Illustrative embodiments may employ an umbilical hanger that threads and/or secures to a tubing hanger assembly. Weight of ESP assembly 100 hanging from umbilical hanger 1300 may squeeze to seal umbilical 215 at umbilical hanger 1300 such that the well is sealed below umbilical hanger 1300. Multiple umbilical hangers 1300 may be employed for sealing redundancy. For example, a first umbilical hanger 1300 may be attached to tubing hanger 1305, and a second umbilical hanger 1300 may be attached above bonnet 360.

Figure 20:
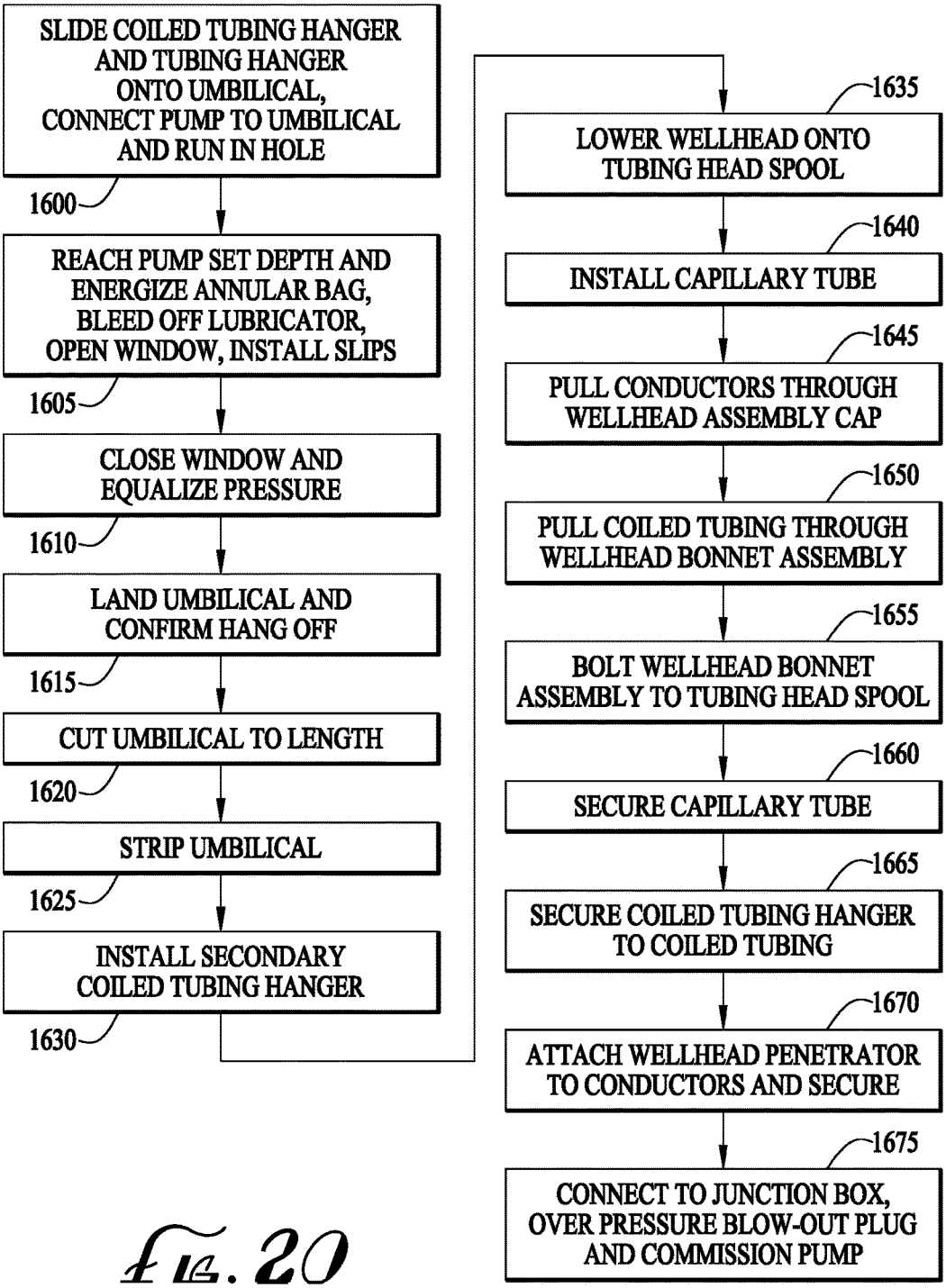
FIG. 20 is a flowchart of an umbilical hanging method of illustrative embodiments.

FIG. 20 is a flowchart of an umbilical hanging method. At step 1600, umbilical hanger 1300 may be thread with retaining ring 1235, sealing elements 1230, and slip guide 1225 minus cap 1215 and slips 1220 into tubing hanger 1305. Both umbilical hanger 1300 and tubing hanger 1305 may then be slid onto umbilical 215 extending from riser 1430 and secured with C clamp above where discharge adapter body 205 is to be installed. ESP assembly 100 may be connected to umbilical 215 and run in hole. At step 1605, pump set depth may be reached and annular bag 1205 may be energized or pipe rams 1405 may be closed. Well control may be confirmed. Once well control is confirmed, lubricator 1430 may be bled, window 1425 opened and slips 1220 may be fastened around umbilical 215. At step 1610, window 1425 may be closed, annular bag 1205 may be de-energized and/or pipe rams 1405 may be opened and pressure equalized. At step 1615, slips 1220 may then be landed in tubing hanger 1305. Once slips 1220 are landed and hang off is confirmed by weight, tighten lock down screws on tubing head spool 1310. ESP assembly 100 may be landed and confirm hang off. At step 1620, confirm well control. Once well control is confirmed bleed lubricator 1430 and BOP stack 1700. Window may be opened and umbilical 215 may be cut to length determined by wellhead configuration. Lubricator/riser 1430, window 1425 and BOP stack 1700 may then be removed.

At step 1625 umbilical 215 may be stripped to remove jacket 235 and separate coiled tubing 220 and power cables 125 on the stripped portion. At step 1630*a* second umbilical hanger 1300, coiled tubing spacer and coiled tubing knuckle clamp may be installed. At step 1635, wellhead bonnet 360 may be lowered onto tubing head spool 1310 with lifting eye. At step 1640 capillary tube 1035 may be pulled through an opening in wellhead bonnet 360 with a guide tool. At step 1645 power cables 125 may be pulled through a second opening in wellhead bonnet 360. At step 1650, coiled tubing 220 may be fed through a third opening in wellhead bonnet 360. At step 1655, wellhead bonnet 360 may be bolted to tubing head spool 1310. At step 1660, a lens lock type fastening may be slid over capillary tube 1035 and tightened to secure capillary tube 1035. At step 1665, a second umbilical hanger 1300 may be slid over coiled tubing 220 and a second set of slips 1220 and retaining cap 1215 may be installed. Retaining caps 1215 may be tightened and coiled tubing 220 may be cut to customer requirements. A bit guide and plumb may be installed to customer specifications. At step 1670, wellhead electrical feedthrough 1400 may be attached to power cables 125 and secured. At step 1675, electrical connections may be completed, blow out plug 200 may be over pressured to be removed from nipple 300 and pushed into catcher 400, and ESP assembly 100 may be commissioned.

Figure 21:
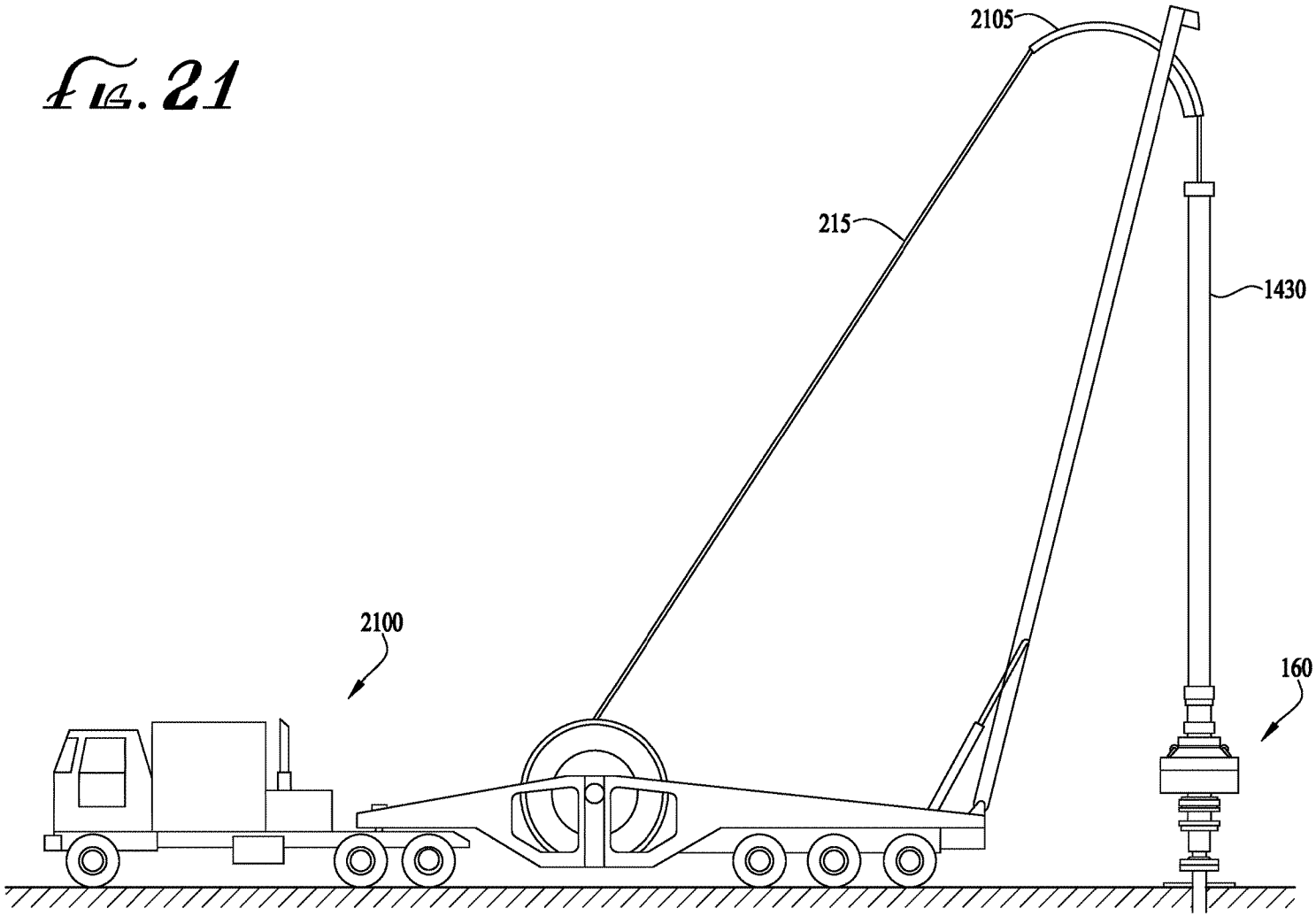
FIG. 21 is a perspective view of illustrative embodiment of a coiled tubing rig used during a live well completion method of illustrative embodiments.

FIG. 21 illustrates coiled tubing rig 2100 of an illustrative embodiment deploying an exemplary artificial lift assembly. As explained herein, a coiled tubing rig 2100 may replace the conventionally employed service or workover rig using the embodiments described herein.

Illustrative embodiments may eliminate formation damage due to pressure and kill fluids, mitigate the risks of an open well bore, be faster than conventional methods since there is no running pipe, connections or bandings, more economical since less time and less manpower is required on location and service rigs are not required, and more convenient since the equipment may be readily available and less costly. Coiled tubing rings are smaller and include only one vehicle as opposed to service rigs that require three vehicles. Coiled tubing rigs are typically less than half the cost of a service and are more than twice as fast as running a pump with a service rig. Coiled tubing rigs are easier to mobilize and require half the personnel to operate, only 2-3 personnel as compared to 5-6 persons for a service or workover rig. In addition, coiled tubing rigs are safer and more environmentally sound than service or workover rigs.

Illustrative embodiments may be suitable for low volume, shallow, cost driven applications such as gas well dewatering, coal bed methane and shale gas. Illustrative embodiments may also be suitable for medium volume, medium depth, sensitive reservoir, cost sensitive applications such as the Bakken and Cardium formations. Illustrative embodiments may be suitable for high volume, deep, remote, service and reservoirs sensitive applications such as North Alaska, McKenzie Delta, Norman Wells, Hibernia and White Rose. Illustrative embodiments may be suitable for mining applications with limited access to conventional oil field services such as Logan Lake, Horizon, Sunrise and Diavik. Illustrative embodiments may be suitable for large slat well applications such as SAGD, water source and mining.

An apparatus, system and method for live well artificial lift completion has been described. Illustrative embodiments provide an apparatus, system and method for live well artificial lift completion. A live well completion capsule may include an umbilical with power cables extruded inside the umbilical jacket. This improved umbilical design allows an unimpeded outer umbilical surface, which may allow annular pressure to be maintained between the umbilical and well casing during live well completion. An annular bag and umbilical hanger wellhead employed in a dual function may manage annular pressure and also include a dognut style wellhead hanger to support the umbilical and artificial lift assembly hanging in the well. A blowout plug and catcher may be inserted into the pump discharge. The blowout plug may maintain pressure inside the umbilical during live well completion. The live well completion capsule of illustrative embodiments may be employed in a method of live well completion. A lubricator, with artificial lift assembly installed, may be lifted over the blowout preventer and wellhead. The ESP may then be lowered into the well via coil tubing rig and then hung off, without losing pressure. The lubricator may then be removed.

Illustrative embodiments enable live well completion without the use of kill fluids, thereby improving well productivity. Illustrative embodiments may improve safety over open well completion by reducing exposure to harmful gases such as $H_2S$. Illustrative embodiments may further improve scheduling and economics by eliminating the need for a service rig. Illustrative embodiments provide a system and method for controlling live well pressure during well completion and workover.

Further modifications and alternative embodiments of various aspects of the invention may be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the scope and range of equivalents as described in the following claims. In addition, it is to be understood that features described herein independently may, in certain embodiments, be combined.

What is claimed is:

1. A live well artificial lift completion system comprising:

an artificial lift pump discharge;

a discharge adapter body secured between the artificial lift pump discharge and an umbilical, the discharge adapter body comprising an electrical connector fastened to an exterior of the discharge adapter body;

an inner diameter of the discharge adapter body fluidly coupled to the artificial lift pump discharge;

the umbilical comprising:

coiled tubing, the coiled tubing supportively hanging from an umbilical hanger within a wellhead, the umbilical hanger secured to a tubing hanger, the tubing hanger and umbilical hanger positioned in a tubing head spool;

an inner diameter of the coiled tubing fluidly coupled to the inner diameter of the discharge adapter body;

a jacket surrounding the coiled tubing; and a power cable extruded inside the jacket, wherein the power cable is connectable between the electrical connector of the discharge adapter body and a surface power source.

2. The live well artificial lift completion system of claim 1, further comprising a multi-stage centrifugal pump fluidly coupled to the artificial lift pump discharge, the multi-stage centrifugal pump driven by an electric submersible motor, the electric submersible motor electrically coupled to the electrical connector of the discharge adapter body.

3. The live well artificial lift completion system of claim 2, wherein a motor lead cable, the electrical connector and the power cable together extend between the electric submersible motor and the surface power source to provide power to the electric submersible motor.

4. The live well artificial lift completion system of claim 2, wherein the multi-stage centrifugal pump is positioned in a downhole well and the multi-stage centrifugal pump lifts production fluid through the pump discharge, through the inner diameter of the discharge adapter body, and through the inner diameter of the coiled tubing of the umbilical.

5. The live well artificial lift completion system of claim 1, comprising a plurality of the power cables extruded inside the jacket, and at least one supportive rib extruded inside the jacket between two adjacent power cables of the plurality of power cables.

6. The live well artificial lift completion system of claim 1, comprising three power phases extruded inside the jacket, each power phase split into two power cables, and wherein a rib is supportively engaged between the two power cables of each power phase.

7. The live well artificial lift completion system of claim 1, further comprising a capillary tube extruded inside the jacket.

8. The live well artificial lift completion system of claim 1, further comprising a blowout plug removeably attached within the artificial lift pump discharge.

9. The live well artificial lift completion system of claim 8, wherein the blowout plug is moveable between:

a blocking position that prevents fluid flow through the artificial lift pump discharge, wherein the blowout plug is secured in a nipple in the blocking position; and an open position that opens the artificial lift pump discharge to fluid flow, the blowout plug positioned in a catcher in the open position.

10. The live well artificial lift completion system of claim 1, wherein the jacket comprises a pair of plastic walls and a fiber filling between the pair of plastic walls, wherein the power cable is extruded in the fiber filling.

* * * * *